US012253278B2

(12) United States Patent
Liu et al.

(10) Patent No.: US 12,253,278 B2
(45) Date of Patent: Mar. 18, 2025

(54) DEHUMIDIFIER

(71) Applicants: GD MIDEA AIR-CONDITIONING EQUIPMENT CO., LTD., Foshan (CN); MIDEA GROUP CO., LTD., Foshan (CN)

(72) Inventors: Fashen Liu, Foshan (CN); Zhicai Cai, Foshan (CN); Kangwen Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 861 days.

(21) Appl. No.: 17/430,939

(22) PCT Filed: Sep. 30, 2020

(86) PCT No.: PCT/CN2020/119203
§ 371 (c)(1),
(2) Date: Aug. 13, 2021

(87) PCT Pub. No.: WO2022/027810
PCT Pub. Date: Feb. 10, 2022

(65) Prior Publication Data

US 2022/0307705 A1 Sep. 29, 2022

(30) Foreign Application Priority Data

Aug. 6, 2020 (CN) ..... 202010786623.1
Aug. 6, 2020 (CN) ..... 202021623960.0

(51) Int. Cl.
*F24F 3/14* (2006.01)
*F24F 1/0358* (2019.01)
*F24F 13/22* (2006.01)

(52) U.S. Cl.
CPC ..... *F24F 3/14* (2013.01); *F24F 1/0358* (2019.02); *F24F 13/22* (2013.01)

(58) Field of Classification Search
CPC ..... F24F 13/222; F24F 1/0358; F24F 13/22; F24F 3/14; F24F 2221/12; F24F 2006/008; F24F 13/20; F24F 2003/144
See application file for complete search history.

(56) References Cited

U.S. PATENT DOCUMENTS

2019/0137121 A1* 5/2019 Swanson ..... F24F 1/028
2020/0182490 A1* 6/2020 Li ..... F24F 1/035
2023/0018141 A1* 1/2023 DeRossett ..... F26B 21/086

FOREIGN PATENT DOCUMENTS

CN 102222582 A 10/2011
CN 103617017 A 3/2014
(Continued)

OTHER PUBLICATIONS

Canadian Intellectual Property Office the Office Action for CA Application No. 3129091 Dec. 13, 2022 5 Pages.
(Continued)

*Primary Examiner* — Frantz F Jules
*Assistant Examiner* — Martha Tadesse
(74) *Attorney, Agent, or Firm* — Anova Law Group, PLLC

(57) ABSTRACT

A dehumidifier includes a water tank, a machine body configured to be at least partially accommodated in the water tank in an idle state, and a position limiting structure including a stopper movably mounted at a side wall of the water tank. The stopper is configured to move between a first position and a second position. At the first position, the stopper is located on a movement path of the machine body moving toward inside of the water tank, to restrict the machine body from moving to the idle state. At the second position, the stopper avoids the movement path of the
(Continued)

machine body moving toward the inside of the water tank, to allow the machine body to move to the idle state.

20 Claims, 13 Drawing Sheets

(56) References Cited

FOREIGN PATENT DOCUMENTS

| | | | | | |
|---|---|---|---|---|---|
| CN | 104006620 | A | | 8/2014 | |
| CN | 105276712 | A | | 1/2016 | |
| CN | 105444276 | A | | 3/2016 | |
| CN | 106906799 | A | | 6/2017 | |
| CN | 107238146 | A | * | 10/2017 | ..... F24F 13/20 |
| CN | 107270431 | A | | 10/2017 | |
| CN | 206846951 | U | | 1/2018 | |
| CN | 108826503 | A | | 11/2018 | |
| CN | 109002124 | A | | 12/2018 | |
| CN | 208349451 | U | | 1/2019 | |
| CN | 109631299 | A | | 4/2019 | |
| CN | 109795390 | A | | 5/2019 | |
| CN | 109869837 | A | | 6/2019 | |
| CN | 209246291 | U | | 8/2019 | |
| CN | 110748989 | A | | 2/2020 | |
| CN | 110932139 | A | | 3/2020 | |
| CN | 210724883 | U | | 6/2020 | |
| CN | 210842674 | U | | 6/2020 | |
| CN | 211121291 | U | | 7/2020 | |
| CN | 211177191 | U | | 8/2020 | |
| CN | 211177193 | U | * | 8/2020 | |
| CN | 211177195 | U | | 8/2020 | |
| CN | 212619197 | U | | 2/2021 | |
| CN | 212619198 | U | | 2/2021 | |
| IN | 101973243 | A | | 2/2011 | |
| IN | 112146189 | A | | 12/2020 | |
| JP | 2003172525 | A | | 6/2003 | |
| KR | 20070044210 | A | | 4/2007 | |
| KR | 20130055370 | A | | 5/2013 | |
| KR | 20140093007 | A | | 7/2014 | |

OTHER PUBLICATIONS

The China National Intellectual Property Administration (CNIPA) The Grant for Chinese Application 202011235589.5 Nov. 2, 2021 7 Pages (With Translation).

The European Patent Office (EPO) Extended Search Report for EP Application No. 20886203.7, Feb. 22, 2022 9 Pages.

Daming Chen et al., "Design and Application of Simple Liquid Switch on the Dehumidifier", Electrical Appliances 2015 (7), pp. 96-99 and 106, Jul. 2015, China Academic Journal Elctronic Publishing House.

World Intellectual Property Organization (WIPO) International Search Report and Written Opinion for PCT/CN2020/119203 Apr. 25, 2021 18 pages (including translation).

The China National Intelleectual Property Administration (CNIPA) First Office Action for Chinese Application No. 202011235589.5, Jun. 28, 2021 11 pages (including translation).

Journal of Refrigeration Simulation Analysis and Optimization Research on Cooling and Dehumidifying Effects of Evaporator Liu shuailing et al. Apr. 2020 25 pages (including translation).

* cited by examiner

DEHUMIDIFIER

CROSS REFERENCE TO RELATED APPLICATIONS

This application is a National Stage Entry under 35 U.S.C. § 371 of International Application No. PCT/CN2020/119203, filed Sep. 30, 2020, which claims priority to Chinese patent applications Nos. 202010786623.1 and 202021623960.0, both filed in the China Patent Office on Aug. 6, 2020 and titled "Dehumidifier." The entire contents of the above-identified patent applications are incorporated herein by reference.

TECHNICAL FIELD

This application relates to the technical field of air dehumidification, in particular to a dehumidifier.

BACKGROUND

In some dehumidifiers, the water tank is arranged outside the machine body. When the dehumidifier works, the machine body is placed above the water tank. After the work is done, the dehumidification water in the water tank needs to be completely discharged and then the machine body is stored in the water tank. However, in actual use, after the work is done, the user often forgets to discharge the water in the water tank, and directly puts the machine body in the water tank with dehumidification water, thus causing water to enter the machine body and damaging the machine body.

SUMMARY

The main purpose of this application is to provide a dehumidifier, which aims to reduce the possibility that a user mistakenly puts the machine body into the water tank and causes water to enter the machine body and damage the machine body when there is water in the water tank.

To achieve the above purpose, this application provides a dehumidifier including:

a water tank with a mounting opening facing upward;

a machine body having an idle state, the machine body being at least partially accommodated in the water tank through the mounting opening in the idle state; and a position limiting structure including a stopper, the stopper being movable into and out of the mounting opening and having a first position and a second position, the stopper being in the mounting opening and located on a movement path of the machine body moving toward the water tank at the first position, and the stopper being positioned out of the mounting opening for the machine body to be accommodated in the water tank at the second position.

In one embodiment, the machine body further has a working state, the machine body is raised from the water tank through the mounting opening in the working state.

In one embodiment, an inner wall of the water tank is formed with a support protrusion, and a side of the machine body is formed with an avoidance recess, and the avoidance recess extends to a bottom of the machine body, the support protrusion extends into the avoidance recess in the idle state, and the bottom of the machine body is supported by an upper end of the support protrusion in the working state.

In one embodiment, a mounting position is arranged below the support protrusion, the stopper is slidably installed at the mounting position, a sliding direction of the stopper is along a transverse direction, at the first position, the stopper extends laterally toward the support protrusion to restrict the machine body from moving toward the water tank, and at the second position, the stopper is retracted to the mounting position for the machine body to be accommodated in the water tank.

In one embodiment, the position limiting structure further includes a pressing block slidably installed at the water tank, and a sliding direction of the pressing block is along an up and down direction, a linkage structure is arranged between the pressing block and the stopper, thereby when the pressing block slides downward, the stopper slides from the second position to the first position.

In one embodiment, the pressing block is slidably mounted at the mounting position, at the second position, an upper end of the pressing block is higher than the upper end of the support protrusion, and at the first position, the upper end of the pressing block is not higher than the upper end of the support protrusion.

In one embodiment, the linkage structure includes a first sliding member provided at the pressing block and a second sliding member provided at the stopper, at least one of the first sliding member or the second sliding member extends obliquely upward in a direction in which the stopper slides out of the mounting position.

In one embodiment, the first sliding member includes a sliding groove extending obliquely upward in the direction in which the stopper slides out of the mounting position, and the second sliding member includes a sliding protrusion slidably mounted in the sliding groove; and/or, the first sliding member has a first surface facing downward and the second sliding member has a second surface facing the first surface, at least one of the first surface or the second surface extends obliquely upward in the direction in which the stopper slides out of the mounting position.

In one embodiment, the position limiting structure further includes a shield covering the mounting position, and the stopper and the pressing block are located between the shield and the inner wall of the water tank.

In one embodiment, a first guide structure is provided between the shield and the stopper, and configured to restrict a movement of the stopper in the up and down direction.

In one embodiment, the first guide structure includes a first guide groove formed at the shield, extending transversally and having a first exiting opening, the stop member is slidably mounted in the first guide groove and capable of protruding from the first exiting opening.

In one embodiment, the first guide structure includes a first guide hole formed at the stopper and a first guide post provided at the shield, the first guide hole extends transversally to form a long strip shape, and the first guide post is slidably installed in the first guide hole.

In one embodiment, the first guide post is provided with a first limiting protrusion located at a free end of the first guide post and protruding toward a lateral direction of the first guide post, the stopper is slidably installed between the first limiting protrusion and the shield.

In one embodiment, the stopper is formed with first material reduction holes arranged at an outer side of the first guide hole at intervals and extending along an extension direction of the first guide hole.

In one embodiment, the first guide hole is provided with a necking portion, a width of the first guide hole at the necking portion is smaller than a size of the first guide post, at the second position, the first guide post is located on a side of the necking portion away from the pressing block.

In one embodiment, the stopper has at least one first sliding surface facing the shield or the inner wall of the water tank, and the first sliding surface is provided with a first sliding rib extending along the sliding direction of the stopper.

In one embodiment, a second guide structure is provided between the shield and the pressing block, and configured to restrict a movement of the pressing block in the transverse direction.

In one embodiment, the second guide structure includes a second guide groove formed at the shield, extending in the up and down direction and having a second existing opening facing upward, the pressing block is slidably mounted in the second guide groove and capable of protruding from the second protruding opening; and/or, the second guide structure includes a second guide hole formed at the pressing block and a second guide post configured on the shield, the second guide hole extends along the up and down direction to form a long strip shape, and the second guide post is slidably installed in the second guide hole.

In one embodiment, the pressing block is provided with an elastic buckle, a surface of the shield facing the mounting position is formed with a stop hole, the stop hole extends and penetrates through a surface of the shield facing away from the mounting position, and at the first position, the elastic buckle is engaged in the stop hole.

In one embodiment, the surface of the shield facing the mounting position is formed with an avoidance slot extending in the up and down direction, the avoidance slot is arranged above the stop hole and spaced from the stop hole, at the second position, the elastic buckle is located in the avoidance slot.

In one embodiment, the support protrusion includes an upper support plate and a lower support plate arranged below the upper support plate and spaced from the upper support plate, the mounting position is formed between the upper support plate and the lower support plate, both the upper support plate and the lower support plate extend transversely, the upper support plate has a break, and the pressing block extends upward from the break.

In one embodiment, the shield is detachably connected to the support protrusion.

In the technical scheme of this application, a stopper capable of movably entering and exiting the mounting opening is arranged at the water tank. When the stopper is moved to a first position in the mounting opening, the stopper can be located on a movement path of the machine body moving toward the water tank, so that when the machine body moves toward the water tank, the stopper can abut against a bottom of the machine body, and the movement of the machine body toward the water tank can be restricted. Therefore, the situation that the machine body directly falls into dehumidification water in the water tank and is damaged can be avoided, that is, the possibility of water damage to the machine body caused by a user mistakenly putting the machine body into the water tank when the water tank contains dehumidification water is reduced.

BRIEF DESCRIPTION OF THE DRAWINGS

In order to more clearly explain the embodiments of this application or the technical solutions in the related art, the drawings used in the description of the embodiments or the related art will be briefly introduced below. Obviously, the drawings in the following description are merely some embodiments of this application. For those of ordinary skill in the art, other drawings can be obtained based on the structure shown in these drawings without creative work.

DESCRIPTION OF REFERENCE NUMERALS IN THE FIGURES

Figure 1:
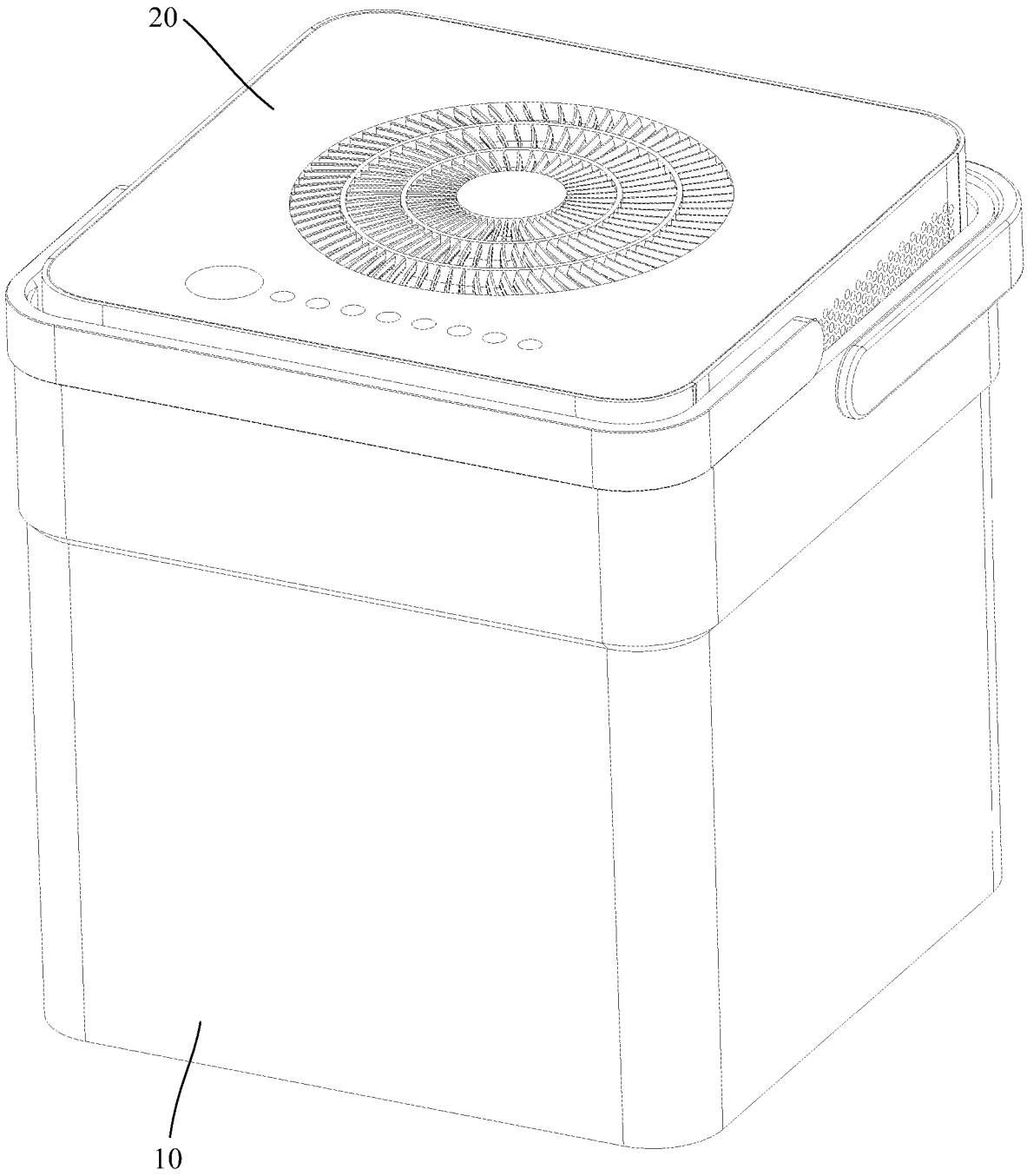
FIG. 1 is a schematic structural diagram of a dehumidifier according to an embodiment of this application, with a machine body being in an idle state.
Figure 2:
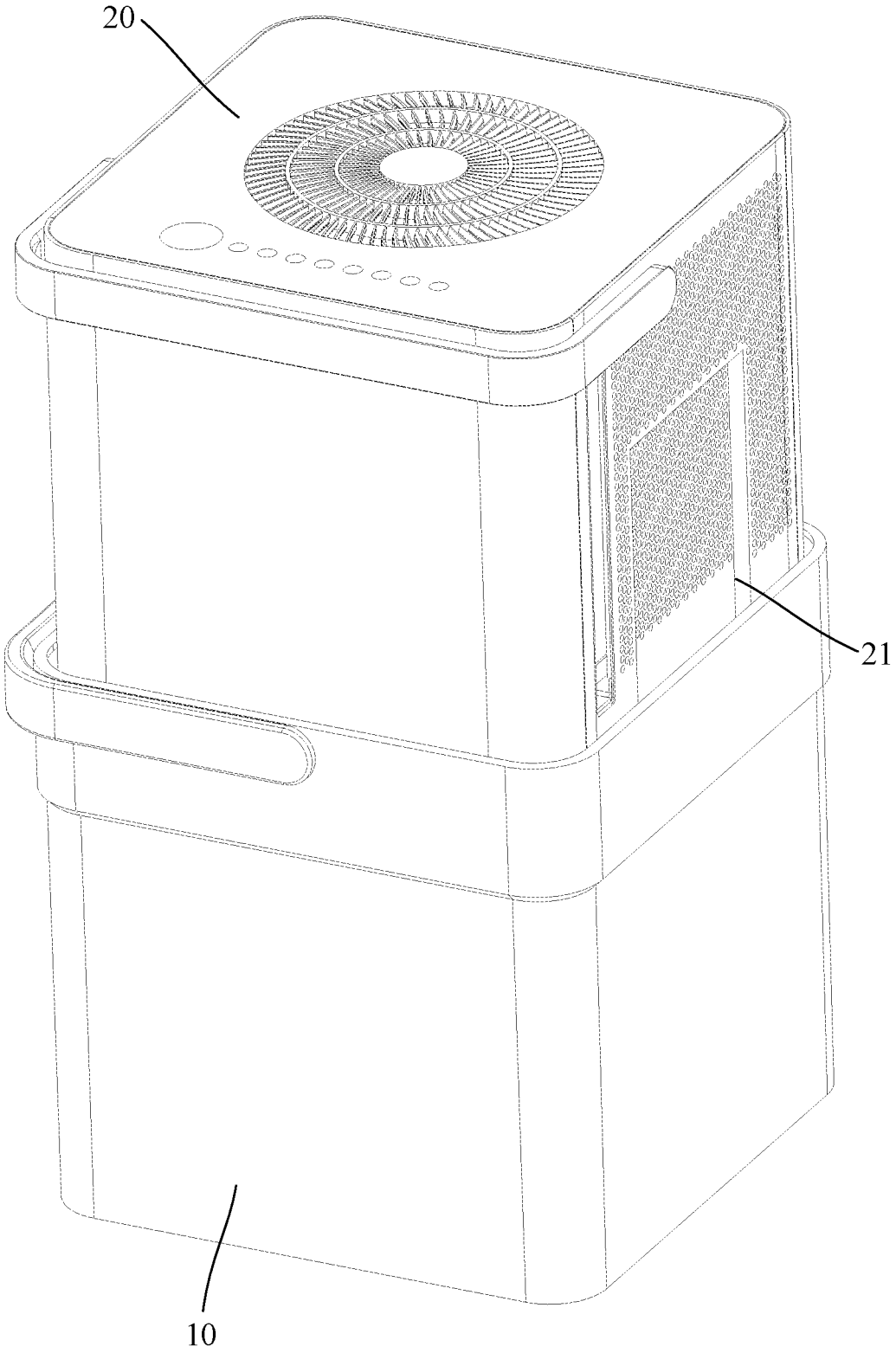
FIG. 2 is a schematic structural diagram of the machine body and the water tank of FIG. 1, with the machine body being in a working state.
Figure 3:
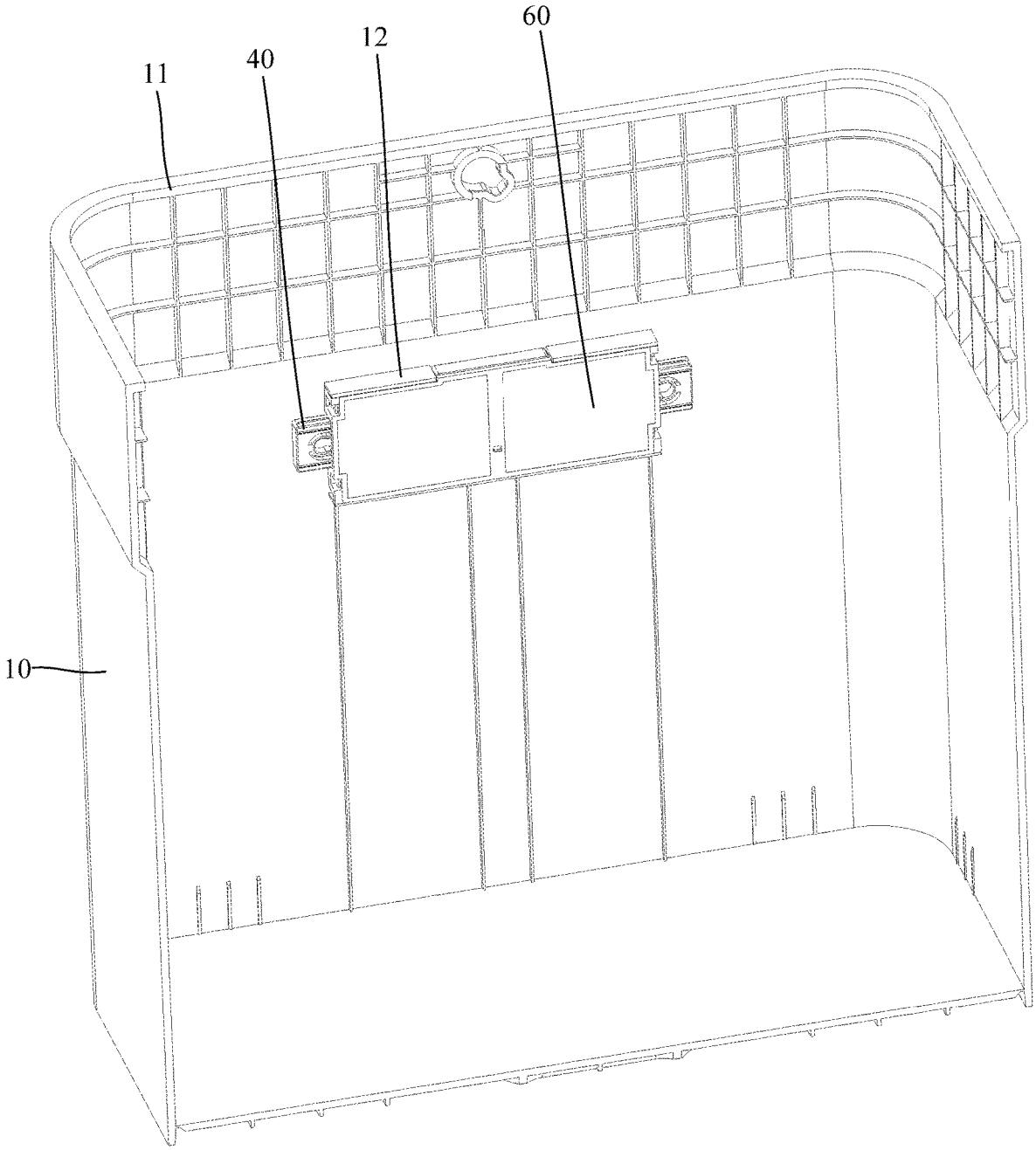
FIG. 3 is a schematic sectional view of the water tank of FIG. 2, with a stopper being in a first position.

| Reference Numeral | Name |
|---|---|
| 10 | Water tank |
| 11 | Mounting opening |
| 12 | Support protrusion |
| 121 | Upper support plate |
| 122 | Lower support plate |
| 123 | First reinforcement rib |
| 124 | Second reinforcement rib |
| 125 | Buckle |
| 20 | Machine body |
| 21 | Avoidance recess |
| 31 | Sliding groove |
| 32 | First surface |
| 33 | Sliding protrusion |
| 34 | Second surface |
| 40 | Stopper |
| 41 | First guide hole |
| 42 | Necking portion |
| 43 | First material reduction hole |
| 44 | First sliding rib |
| 50 | Pressing block |
| 51 | Second guide hole |
| 52 | Second material reduction hole |
| 53 | Second sliding rib |
| 54 | Elastic buckle |
| 60 | Shield |
| 61 | First guide groove |
| 62 | First exiting opening |
| 63 | First guide post |
| 631 | First limiting protrusion |
| 64 | Second guide groove |
| 641 | Second exiting opening |
| 65 | Second guide post |
| 651 | Second limiting protrusion |
| 66 | Stop hole |
| 67 | Avoidance slot |
| 68 | Buckle hole |

The realization of the purposes, functional features and advantages of this application will be further explained with reference to the accompanying drawings in combination with the embodiments.

DETAILED DESCRIPTION OF THE EMBODIMENTS

In the following, the technical solutions in the embodiments of this application will be clearly and completely described with reference to the drawings in the embodiments of this application. Obviously, the described embodiments are only some of the embodiments of this application, and not all of the embodiments. Based on the embodiments of this application, all other embodiments obtained by those of ordinary skilled in the art without creative efforts shall fall within the claimed scope of this application.

It should be noted that all directional indicators (such as up, down, left, right, front, back, etc.) in the embodiments of this application are only used to explain the relative positional relationship, movement situation, etc. between components in a specific attitude (as shown in the drawings). If the specific attitude changes, the directional indication also changes accordingly.

In addition, the descriptions related to "first," "second," and the like in this application are for descriptive purposes only, and should not be understood as indicating or implying their relative importance or implicitly indicating the number of technical features indicated. Therefore, a feature associated with "first" and "second" may explicitly or implicitly include at least one of such feature. In addition, the meaning of "and/or" in the full text is to include three scenarios. Taking "A and/or B" as an example, it includes a scenario having A, a scenario having B, or a scenario that A and B are both met. In addition, the technical solutions of the various embodiments can be combined with each other, but they must be based on what can be achieved by those of ordinary skill in the art. When the combination of technical solutions is contradictory or cannot be achieved, it should be considered that such a combination of technical solutions does not exist, or is not within the scope of protection defined by the claims of this application.

This application provides a dehumidifier.

In the embodiment of this application, please refer to FIGS. 1 to 4, the dehumidifier includes a water tank 10, a machine body 20 and a position limiting structure. The water tank 10 has an upward mounting opening 11, and the machine body 20 has an idle state in which the machine body 20 is at least partially housed in the water tank 10 through the mounting opening 11.

The position limiting structure includes a stopper 40, which can move into and out of the mounting opening 11, and has a first position and a second position. In the first position, the stopper 40 enters in the mounting opening 11 and is located on a movement path of the machine body 20 moving toward inside of the water tank 10. In the second position, the stopper 40 is positioned out of the mounting opening 11 for the machine body 20 to be accommodated in the water tank 10.

In this embodiment, dehumidification water generated when the machine body 20 performs dehumidification can enter the water tank 10. The machine body 20 and the water tank 10 are both square in shape, however those are the shapes of the machine body 20 and the water tank 10 in only one embodiment. In other embodiments, the machine body 20 and the water tank 10 may be, but are not limited to, circular, polygonal, or even irregular in shape, and the machine body 20 can be at least partially received within the water tank 10 through the mounting opening 11.

When the machine body 20 is taken out of the water tank 10 for dehumidification, the stopper 40 can be moved to the first position and enter the mounting opening 11 (the stopper 40 can be switched to the first position when the machine body 20 is taken out of the water tank 10, or when there is a certain amount of dehumidification water in the water tank 10 after the machine body 20 has operated for a certain period of time, or when the machine body 20 is lifted again after the machine body 20 has operated for a certain period of time). At this time, the stopper 40 is located on the movement path of the machine body 20 moving toward inside of the water tank 10, so that when the machine body 20 moves toward inside of the water tank 10, the stopper 40 can abut against a bottom of the machine body 20, and can restrict the machine body 20 from moving toward inside the water tank 10. When the machine body 20 finishes working and the dehumidification water in the water tank 10 is discharged or poured out, the stopper 40 is switched to the second position out of the mounting opening 11, so that the machine body 20 can move toward inside the water tank 10 and be accommodated in the water tank 10.

In the technical scheme of this application, a stopper 40 capable of movably entering and exiting a mounting opening 11 is provided at the water tank 10, when the stopper 40 moves to a first position in the mounting opening 11, the stopper 40 can be located on a movement path of the machine body 20 moving toward inside of the water tank 10, so that when the machine body 20 moves toward inside of the water tank 10, the stopper 40 can abut against a bottom of the machine body 20, and can restrict the machine body 20 from moving toward inside of the water tank 10. Therefore, it can avoid the case where the machine body 20 falls directly into the dehumidification water in the water tank 10 and is damaged, that is, it can reduce the case where the water tank 10 has dehumidification water, and the user mistakenly puts the machine body 20 into the water tank 10 and causes water damage to the machine body 20.

By disposing the water tank 10 outside the machine body 20, a volume of the water tank 10 is larger, a storage capacity of the water tank 10 is increased, the number of times a user pours water is reduced, and the weight of the machine body 20 is also reduced which facilitates the user to carry the machine body 20. In addition, when the machine body 20 is in an idle state, the machine body 20 is received in the water tank 10, the center of gravity of the dehumidifier can be lowered, so that the dehumidifier can be placed stably and is not easy to fall, and an overall occupied space of the dehumidifier is reduced and the user can place the dehumidifier conveniently.

In this embodiment, the machine body 20 also has a working state, in which the machine body 20 is raised from the water tank 10 through the mounting opening 11. Specifically, in the working state, the machine body 20 at least partially protrudes above the water tank 10, for example, a portion of the machine body 20 provided with an air inlet and an air outlet is located above the water tank to be exposed outside the water tank 10, which substantially elevates a position of the air outlet of the machine body 20, so that the dehumidified air can be blown to a further position, and it is beneficial to improve a range of indoor air flow. Moreover, the dehumidification water generated by the machine body 20 can naturally fall into the water tank 10, and it is convenient for collecting the dehumidification water. Of course, in other embodiments, the machine body 20 may be disposed entirely outside the water tank 10.

In one embodiment, an inner wall of the water tank 10 is provided with a support protrusion 12, and a side of the machine body 20 is provided with an avoidance recess 21. The avoidance recess 21 extends to the bottom of the machine body 20. In the idle state, the support protrusion 12 extends into the avoidance recess 21. In the working state, an upper end of the support protrusion 12 supports the bottom of the machine body 20. Specifically, the water tank 10 is provided outside the machine body 20, the support protrusion 12 is provided spaced from a bottom wall of the water tank 10, and the support protrusion 12 is provided spaced from an edge of the mounting opening 11. That is, the upper end of the support protrusion 12 is lower than an upper end edge of the water tank 10, and the avoidance recess 21 extends in a height direction (an up and down direction) of the machine body 20.

When the dehumidifier is used, the machine body 20 is rotated until the avoidance recess 21 is staggered with the supporting protrusion 12 of the water tank 10, so that the bottom of the machine body 20 abuts against the upper end of the supporting protrusion 12, the machine body 20 is supported by the supporting protrusion 12 and raised from the water tank 10. At this time, the machine body 20 is in the working state, and the dehumidification water generated during working of the machine body 20 can be discharged into the water tank 10. When the machine body 20 finishes working and the water is discharged from the water tank 10, the machine body 20 is rotated to a state where the avoidance recess 21 faces the support protrusion 12, so that the support protrusion 12 extends into the avoidance recess 21, and the machine body 20 is accommodated in the water tank 10 an stands in the idle state.

Thus, when the upper end of the support projection 12 supports the bottom of the machine body 20, a portion of the machine body 20 remains within the water tank 10. Compared with the way that the machine body 20 is completely raised from the inside of the water tank 10 and placed above the water tank 10, this arrangement enables the portion of the water tank 10 above the upper end of the supporting protrusion 12 to restrict the machine body 20, effectively reduces the turnover of the machine body 20 relative to the water tank 10, and greatly improves the stability of the machine body 20 in the working state. The support protrusion 12 may be a convex structure integrally formed on an inner wall of the water tank 10, or may be a support structure movably mounted on the inner wall of the water tank 10 (the support structure may refer to a mounting mode of the stopper 40). Of course, in other embodiments, the bottom of the machine body 20 may abut against an upper edge of the water tank 10.

In one embodiment, a mounting position is provided below the support protrusion 12, and the stopper 40 is slidably installed at the mounting position. A sliding direction of the stopper 40 is a transverse direction. At the first position, the stopper 40 extends toward a lateral side of the support protrusion 12 to restrict the machine body 20 from moving toward the water tank 10. At the second position, the stopper 40 is retracted to the mounting position for the machine body 20 to be accommodated in the water tank 10.

In particular, a lateral direction of the support projection 12 is the transverse direction (i.e., a horizontal direction). The sliding direction of the stopper 40 may be along a horizontal extension direction of the inner wall of the water tank 10. At the first position, a length of the stopper 40 protruding from the support protrusion 12 is greater than an engagement gap between the support protrusion 12 and the avoidance recess 21, that is, a total length of the stopper 40 and the support protrusion 12 along the horizontal extension direction of the inner wall of the water tank 10 is greater than a width of the avoidance recess 21 along the horizontal extension direction of an outer wall of the machine body 20. When the user mistakenly places the machine body 20 in the water tank 10 in a state where the avoidance recess 21 faces the support protrusion 12, a protruding end of the stopper 40 can support the bottom of the machine body 20, thereby restricting the machine body 20 from continuously entering the water tank 10 downward.

At the second position, the stopper 40 can be retracted to the mounting position, that is, the length of the stopper 40 protruding relative to the support protrusion 12 is smaller than the engagement gap between the support protrusion 12 and the avoidance recess 21, or the stopper 40 is entirely retracted into the mounting position, so as to avoid interference between the stopper 40 and the machine body 20 and ensure that the machine body 20 can smoothly enter the water tank 10. Of course, in other embodiments, the sliding direction of the stopper 40 can be a direction perpendicular to an inner wall surface of the water tank 10. In addition, in other embodiments, the stopper 40 and the support projection 12 can be laterally spaced apart. Further, in other embodiments, the stopper 40 can be rotatably mounted on the inner wall of the water tank 10 to be able to rotate into and out of the mounting opening 11.

By providing a support protrusion 12 on an inner wall of the water tank 10, and a position limiting structure at a mounting position below the support protrusion 12, a stopper 40 of the position limiting structure is slidably mounted at the mounting position. When the stopper 40 slidably protruding toward the lateral side of the support protrusion 12, even if the user mistakenly places the machine body 20 on the water tank 10 in a state where the avoidance recess 21 faces the support protrusion 12, the stopper 40 can abut against the bottom of the machine body 20, thereby restricting the machine body 20 from continuing to fall into the water tank 10. As such, after the machine body 20 is taken out from the water tank 10, prior to startup of the machine body 20, the stopper 40 can protrude toward the support protrusion 12 to prevent the machine body 20 from being put into the water tank 10. Even if the user wants to put the machine body 20 into the water tank 10 after the dehumidifier has operated for a certain period of time when there is already dehumidification water in the water tank 10, the stopper can prevent the machine body 20 from falling directly into the dehumidification water in the water tank 10 and being damaged. It reduces the possibility that when the water tank 10 has dehumidification water, the user mistakenly puts the machine body 20 into the water tank 10 and cause water damage to the machine body 20.

In one embodiment, the inner wall of the water tank 10 is provided with a plurality of support protrusions 12, and the plurality of support protrusions 12 are distributed at intervals along a circumferential direction of the water tank 10. The outer surface of the machine body 20 is provided with a plurality of avoidance recesses 21, and the plurality of avoidance recesses 21 are arranged at intervals along a circumferential direction of the machine body 20. Specifically, each support protrusion 12 corresponds to at least one avoidance recess 21 that is to engage with the support protrusion 12, that is, the number of avoidance recesses 21 can be larger than the number of support protrusions 12, and each support protrusion 12 is engaged with at least one avoidance recess 21 to ensure that the machine body 20 can be accommodated in the water tank 10.

As is understandable, the plurality of support protrusions 12 are arranged at intervals in the circumferential direction of the water tank 10. When the machine body 20 needs to be switched from a idle state to the working state, the machine body 20 can be lifted out of the water tank 10, and rotated for a certain angle relative to the water tank 10, so that the plurality of avoidance recesses 21 and the plurality of support protrusions 12 are dislocated with each other, and the upper end of the support protrusions 12 can support the portion of the bottom of the machine body 20 without the avoidance recesses 21. As such, the bottom of the machine body 20 is jointly supported by the plurality of support protrusions 12, so that a plurality of positions in the circumferential direction of the machine body 20 can be supported, and the stability of the machine body 20 in the working state is improved. When a plurality of support protrusions 12 are provided, the stopper 40 or stoppers 40 may be provided below only one or part of the support protrusions 12, or the stoppers 40 may be provided below each of the support protrusions 12.

The plurality of support protrusions 12 can be evenly arranged along the circumferential direction of the water tank 10, so as to ensure that when the bottom of the machine body 20 abuts against the plurality of support protrusions 12, the force applied on the machine body 20 in the circumferential direction is consistent, which is beneficial to improve the stability of the machine body 20 in the working state. For example, when the number of the supporting protrusions 12 is two, the two supporting protrusions 12 are provided at two opposite sides of the water tank 10, or the like. Of course, in other embodiments, when the number of support protrusions 12 is greater than or equal to three, the plurality of support protrusions 12 may be non-uniformly arranged along the circumferential direction of the water tank 10. In addition, the machine body 20 may be cylindrical, elliptical or prismatic, and the shape of the water tank 10 is adapted to the shape of the machine body 20. When the machine body 20 is prismatic, the water tank may be square, regular pentagonal, regular hexagonal, or the like.

In addition, each mounting position can be provided with one or more stoppers 40, and the sliding directions of the plurality of stoppers 40 are in the transverse direction. For example, in an embodiment, each mounting position is provided with two stoppers 40, and the two stoppers 40 slide out of the mounting position in opposite directions. As such, when the stoppers 40 support the bottom of the machine body 20, the machine body 20 is supported by a plurality of stoppers 40 together, thereby ensuring the stability of the machine body 20 and reducing the possibility of inclination of the machine body 20.

Figure 4:
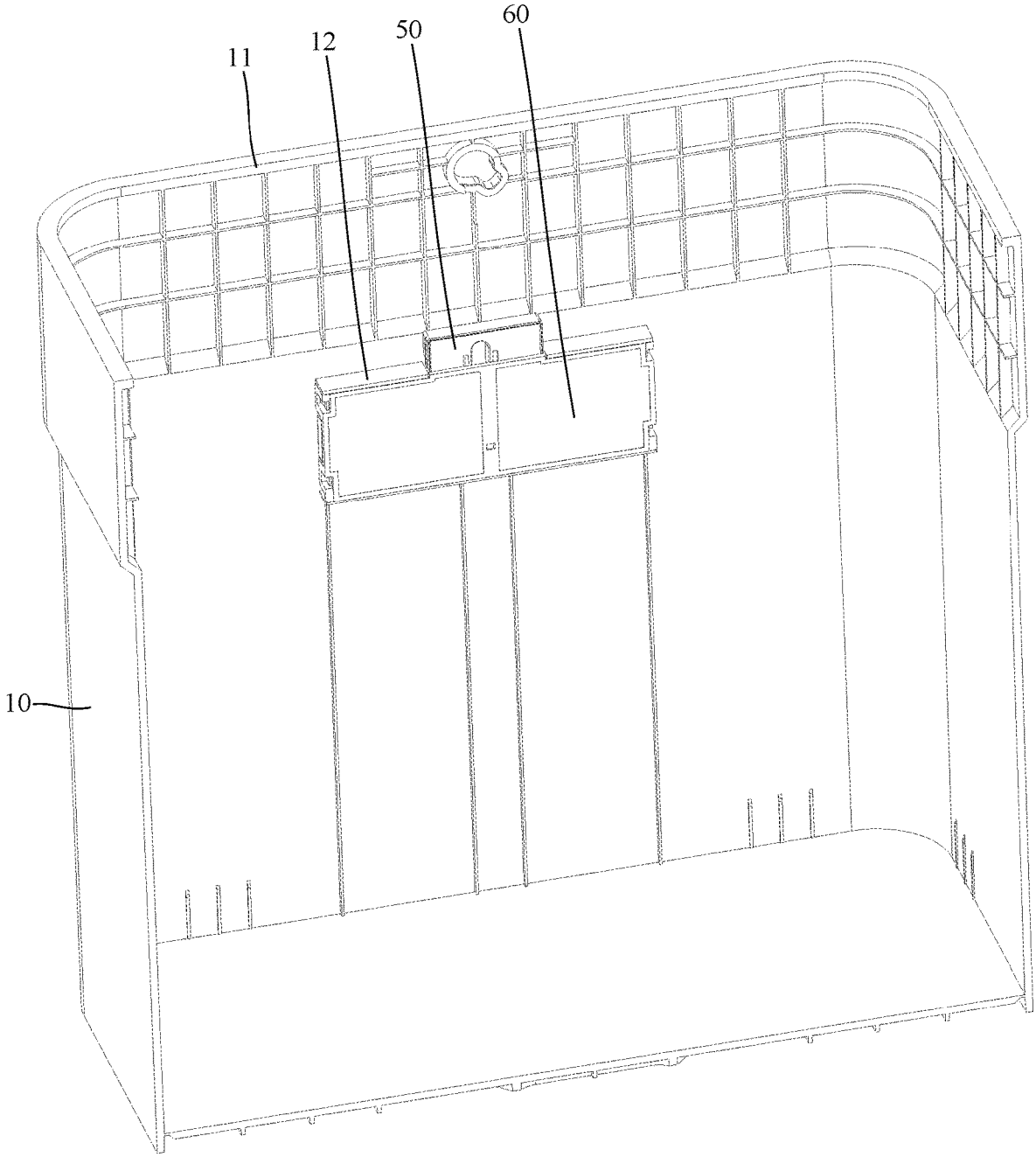
FIG. 4 is a schematic sectional view of the water tank of FIG. 1, with the stopper being in a second position.
Figure 5:
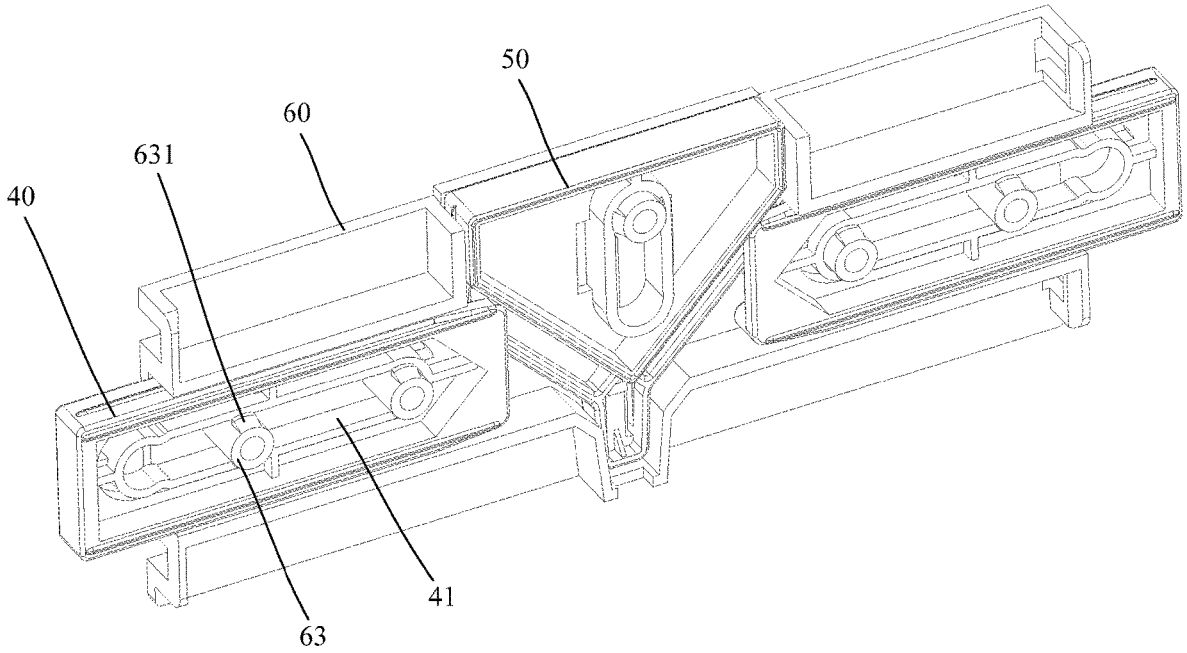
FIG. 5 is a structural diagram of a position limiting structure of FIG. 3.
Figure 6:
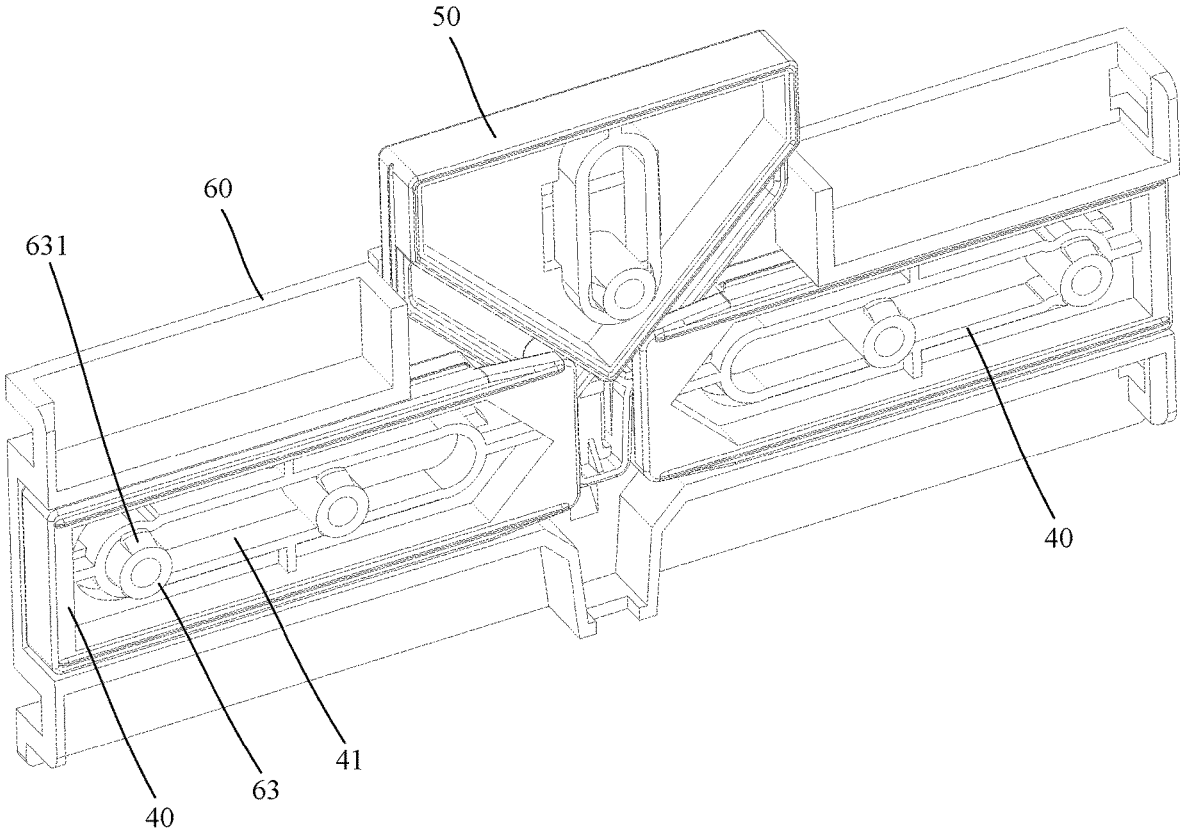
FIG. 6 is a structural diagram of the position limiting structure of FIG. 4.

In order to reduce the user's operation and facilitate the user to use the dehumidifier, please refer to FIGS. 4 to 6. In an embodiment, the position limiting structure further includes a pressing block 50. The pressing block 50 is slidably installed at the water tank 10, and a sliding direction of the pressing block 50 is the up and down direction. A linkage structure is provided between the pressing block 50 and the stopper 40, so that when the pressing block 50 slides downward, the stopper 40 slides from the second position to the first position. The pressing block 50 may be disposed outside the water tank 10 or inside the water tank 10. If the pressing block 50 is disposed inside the water tank 10, an upper end of the pressing block 50 can protrude outward from the mounting opening 11 for the user to operate. Alternatively, the pressing block 50 may be pressed down by the bottom of the machine body 20 abutting against the upper end of the pressing block 50, to drive the stopper 40 to slide from the second position toward the first position. By providing the pressing block 50, the driving of the stopper 40 can be facilitated, and the operation of the user can be facilitated.

In this embodiment, the pressing block 50 is slidably mounted at the mounting position. At the second position, the upper end of the pressing block 50 is higher than the upper end of the support protrusion 12. At the first position, the upper end of the pressing block 50 is not higher than the upper end of the support protrusion 12. Specifically, when the machine body 20 is in the idle state, the stopper 40 is at the second position. At this time, the stopper 40 is raised upward through the linkage structure, so that the upper end of the pressing block 50 is higher than the upper end of the support protrusion 12. When the machine body 20 is switched to the working state, before the bottom of the machine body 20 is placed on the upper end of the supporting protrusion 12, the machine body 20 first abuts against the upper end of the pressing block 50, thereby pressing the pressing block 50 down until the bottom of the machine body 20 abuts against the upper end of the supporting protrusion 12. During the pressing down of the pressing block 50, the pressing block 50 drives the stopper 40 through the linkage structure to protrude laterally toward the support projection 12 and move to the first position. In this way, when the user puts the machine body 20 in the working state, the stopper 40 can be automatically switched to the first position, and the user does not need to manually operate the stopper 40, thus greatly facilitating the user's use.

After the dehumidifier finishes working, since the stopper 40 is in the first position, it is needed to retract the stopper 40 before the machine body 20 can be put into the water tank 10. In one embodiment, the user manually switches the stopper 40 from the first position to the second position, so that when the user manually operates the stopper 40, the user will find whether there is dehumidification water in the water tank 10, thereby avoiding the user directly putting the machine body 20 into the water tank 10 when the user does not find that there is dehumidification water in the water tank 10, resulting in inflow of water and damage to the machine body 20. Of course, in other embodiments, it can be the situation of manually driving the stopper 40 from the mounting position to the first position by the user without providing the pressing block 50. Alternatively, a motor can be provided at the mounting position, and the stopper 40 is driven by the motor to switch between the first position and the second position.

The linkage structure may be one of various of types. For example, in one embodiment, the linkage structure includes a first sliding member provided at the pressing block 50 and a second sliding member provided at the stopper 40. At least one of the first sliding member or the second sliding member extends obliquely upward along the direction in which the stopper 40 slides out of the mounting position. That is, there may be the first sliding member or the second sliding member extending obliquely upward in the direction in which the stopper 40 slides out of the mounting position to form a long strip shape. Alternatively, there may be both the first sliding member and the second sliding member extending obliquely upward along the direction in which the stopper 40 slides out of the mounting position to form long strip shapes.

When the pressing block 50 moves downward, the second sliding member abuts against the first sliding member and slides relative to the first sliding member (along an extension direction of the first sliding member or the second sliding member), thereby driving the stopper 40 to move in the direction of sliding out of the mounting position to move to the first position. When the stopper 40 is switched from the first position to the second position, the first sliding member abuts against the second sliding member and can slide relative to the second sliding member (along the extension direction of the first sliding member or the second sliding member), thereby driving the pressing block 50 to move upward until the stopper 40 moves to the second position. As such, the linkage structure is formed between the pressing block 50 and the stopper 40, the structure is simple, and no additional part is needed, the material is reduced, and the assembly efficiency is improved and the cost is reduced. Of course, in other embodiments, the linkage structure may include a link, a first hinge member provide at the stopper 40, and a second hinge member provided at the pressing block 50, one end of the link is hinged with the first hinge member and the other end of the link is hinged with the second hinge member.

Figure 7:
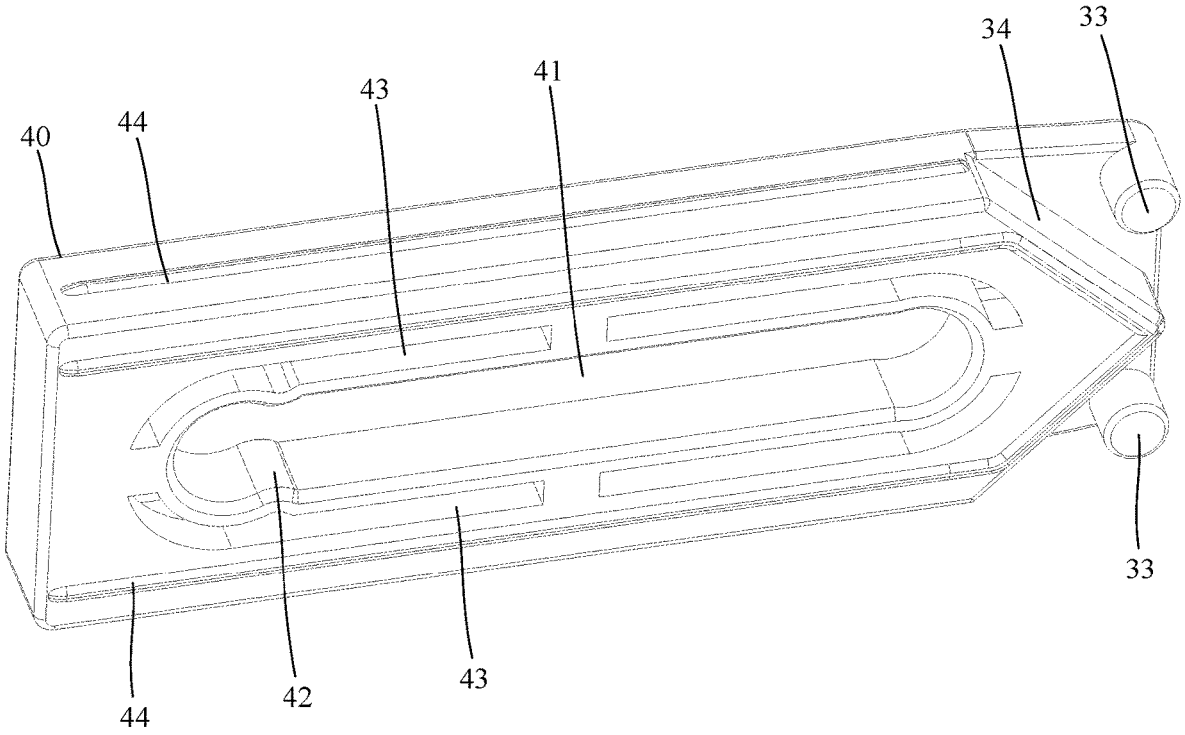
FIG. 7 is a schematic structural diagram of a stopper of FIG. 6.
Figure 8:
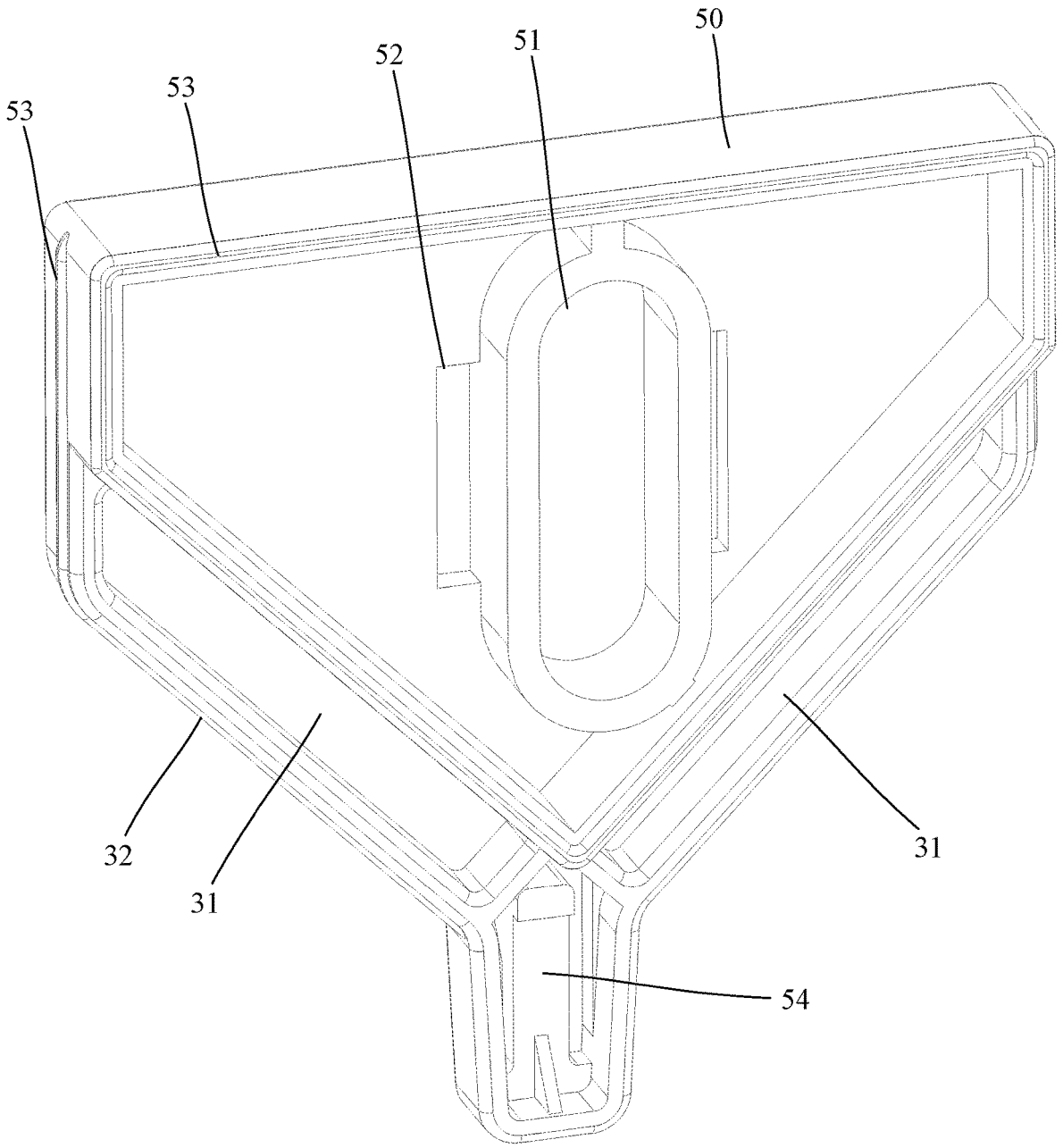
FIG. 8 is a schematic structural diagram of a pressing block of FIG. 6.

Referring to FIGS. 7 and 8, the structure of the first sliding member may vary. For example, in one embodiment, the first sliding member includes a sliding groove 31, which extends obliquely upward along the direction in which the stopper 40 slides out of the mounting position. The second sliding member includes a sliding protrusion 33, and the sliding protrusion 33 is slidably mounted in the sliding groove 31. The sliding groove 31 is formed at the pressing block 50 and the sliding protrusion 33 is provided at the stopper 40, so that the sliding protrusion is always located in the sliding groove 31. That is, when either of the stopper 40 and the pressing block 50 is operated, the other can be linked to move, and the connection reliability between the stopper 40 and the pressing block 50 can be ensured.

When two stoppers 40 are provided at the mounting position (see FIGS. 5 and 6), the structures of the two stoppers 40 can be the same, so that the two stoppers 40 are actually made of the same material, thereby reducing types of materials used and the cost. A sliding groove 31 is provided at the pressing block 50 corresponding to each of the stoppers 40. In one embodiment, the second sliding member includes two sliding protrusions 33, and the two sliding protrusions 33 are provided at the same side of the stopper 40 and distributed at intervals in the up and down direction. For ease of illustration, a center line is formed at each stopper 40, and the center line extends in the sliding direction of the stopper 40 and passes through center points between an upper surface and a lower surface of the stopper 40.

The positions of the two sliding projections 33 on the stopper 40 are symmetrically arranged with the center line as a symmetrical line.

In addition, in one embodiment, the first sliding member has a first surface 32 facing downward, and the second sliding member has a second surface 34 facing the first surface 32. At least one of the first surface 32 or the second surface 34 extends obliquely upwardly in the direction in which the stopper 40 slides out of the mounting position. The first surface 32 and the second surface 34 are in contact with each other and can slide relative to each other when the stopper 40 is in contact with the pressing block 50. Thus, the structure is simple, and structural strengths of the first sliding member and the second sliding member can be guaranteed, which is beneficial to improving the linkage reliability of the stopper 40 and the pressing block 50.

When two stoppers 40 are arranged at the mounting position, the structures of the two stoppers 40 can be the same, so that the two stoppers 40 are actually made of the same material, thereby reducing types of materials used and the cost. In one embodiment, the first sliding member has two first surfaces 32 facing downward, a distance between the two first surfaces 32 gradually increases in an upward direction. The second sliding member has two second surfaces 34, a distance between the two second surfaces 34 gradually increases in the direction in which the stopper 40 slides out of the mounting position. The positions of the two second surfaces 34 on the stopper 40 are arranged symmetrically with the center line as the symmetrical line.

In addition, in an embodiment, the first sliding member includes a sliding groove 31 and a first surface 32 provided below the sliding groove 31, and the second sliding member includes a sliding protrusion 33 and a second surface 34.

Referring to FIGS. 1 to 4, in order to ensure a movement effect of the stopper 40 and the pressing block 50, in one embodiment, the position limiting structure further includes a shield 60. The shield 60 covers the mounting position, and the stopper 40 and the pressing block 50 are located between the shield 60 and the inner wall of the water tank 10. Specifically, the shield 60 is plate shaped and connected to the water tank 10, and an upper end of the shield 60 is not higher than the upper end of the support protrusion 12, so that the bottom of the machine body 20 can abut against the upper end of the support protrusion 12. By covering the shield 60 at the mounting position, the linkage structure between the stopper 40 and the pressing block 50 can be prevented from being exposed to outside, and foreign objects can be prevented from touching the linkage structure or sundries can be prevented from entering the linkage structure, thus playing a better protective role on the linkage structure, and ensuring the linkage reliability of the stopper 40 and the pressing block 50. Of course, in other embodiments, the shield 60 may be in a grid structure or the like, or be omitted.

In one embodiment, a first guide structure is provided between the shield 60 and the stopper 40, and the first guide structure is configured to restrict the stopper 40 from moving up and down. Specifically, the first guide structure extends along the sliding direction of the stopper 40 to ensure that the stopper 40 can slide smoothly between the inner wall of the water tank 10 and the shield 60. Since the first guide structure is disposed between the shield 60 and the stopper 40, there is no need to provide a guide structure on the inner wall of the water tank 10, thereby simplifying the structure of the water tank 10. Of course, in other embodiments, the first guide structure may be provided between the water tank 10 and the stopper 40.

Figure 10:
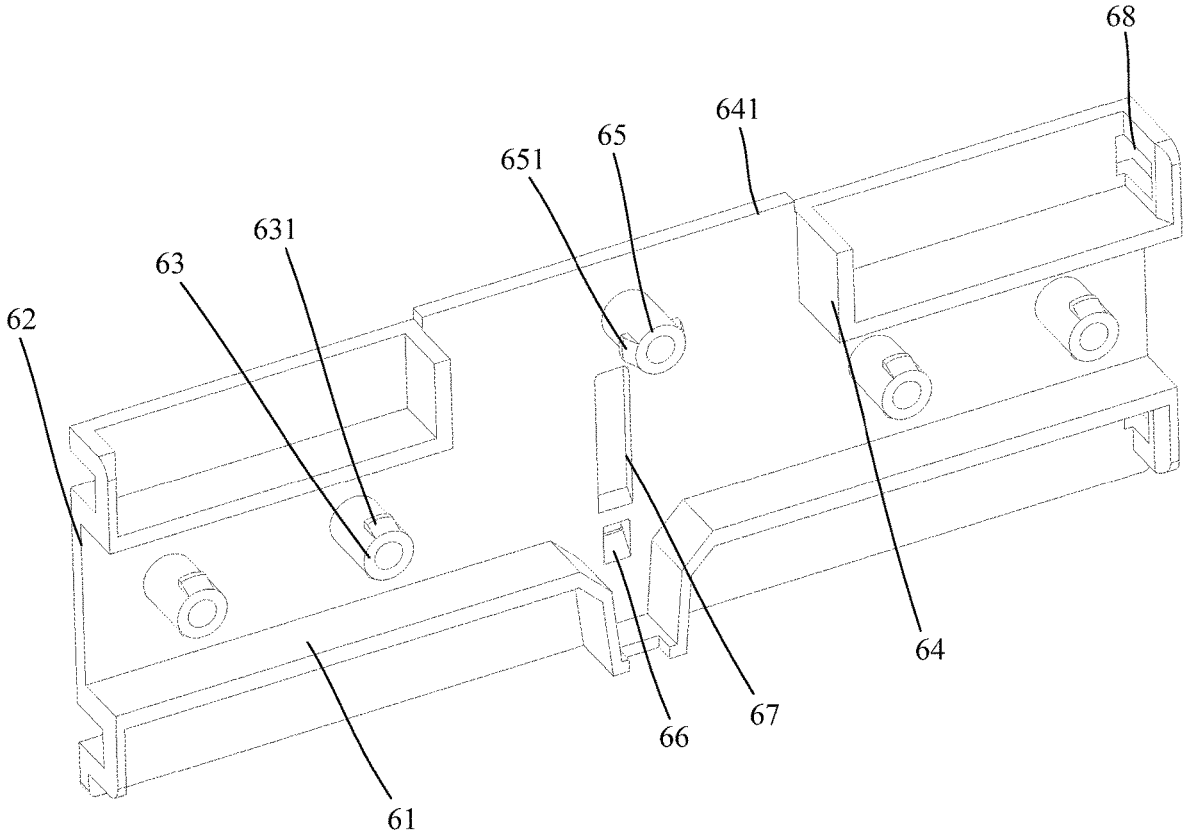
FIG. 10 is a schematic structural diagram of a shield of FIG. 6.

Referring to FIGS. 7 and 10, the first guide structure may have one of various configurations. For example, in one embodiment, the first guide structure includes a first guide groove 61 formed at the shield 60. The first guide groove 61 extends in the transverse direction and has a first exiting opening 62. The stopper 40 is slidably mounted in the first guide groove 61 and can protrude out from the first exiting opening 62. Specifically, the first guide groove 61 extends in the sliding direction of the stopper 40, and the first exiting opening 62 is located at one end of the first guide groove 61 away from the pressing block 50. In one embodiment, the stopper 40 is wholly and slidably installed in the first guide groove 61 as a whole, that is, a lower side portion of the stopper 40 slides relative to a lower side wall of the first sliding groove, and an upper side portion of the stopper 40 is slidably connected with an upper side wall of the first sliding groove. In this way, a structural strength of the first guide structure is high, and the movement reliability of the stopper 40 can be guaranteed to be good. Of course, the stopper 40 may be partially and slidably mounted in the first guide groove 61. Of course, this application is not limited to this, the first guide groove 61 may be formed at the stopper 40. The first guide structure includes a protrusion provided at the shield 60, and the protrusion can protrude from the first guide groove 61.

In addition, in an embodiment, the first guide structure includes a first guide hole 41 formed at the stopper 40 and a first guide post 63 provided at the shield 60. The first guide hole 41 extends in the transverse direction to form a long strip shape, and the first guide post 63 is slidably installed in the first guide hole 41. In particular, the first guide hole 41 extends in the sliding direction of the stopper 40 to form a long strip shape, and both ends of the first guide hole 41 are closed, so that the first guide post 63 can always be located in the first guide hole 41. That is, the stopper 40 can be guided to slide, and the stopper 40 can be prevented from being separated from the shield 60, so that the overall reliability of the position limiting structure is high. A number of first guide posts 63 may be one or more. When the number of the first guide posts 63 is more than one, the plurality of first guide posts 63 are distributed at intervals in the sliding direction of the stopper 40. Of course, this application is not limited to this, the first guide hole 41 may be formed at the shield 60 and the first guide post 63 may be provided at the stopper 40. In addition, in one embodiment, the first guide structure may include the first guide groove 61, the first guide post 63 provided in the first guide groove 61, and the first guide hole 41 formed at the stopper 40.

Referring to FIGS. 5, 6 and 10, in order to facilitate the assembly of the position limiting structure, in one embodiment, the first guide post 63 is provided with a first limiting protrusion 631. The first limiting protrusion 631 is located at a free end of the first guide post 63 and protruding toward a lateral direction of the first guide post 63. The stopper 40 is slidably installed between the first limiting protrusion 631 and the shield 60. Specifically, each of two opposite sides of the free end of the first guide post 63 is provided with one first limiting protrusion 631. Two first limiting protrusions 631 are distributed along a width direction of the first guide hole 41. A protrusion height of the first limiting protrusion 631 relative to a side surface of the first guide post 63 is greater than a gap between the first guide post 63 and the first guide hole 41, and a distance between the first limiting protrusion 631 and a root portion of the first guide post 63 is greater than a depth of the first guide hole 41. After the free end of the first guide post 63 enters from one end of the first guide hole 41 and existed out from the other end of the first guide hole 41, the first limiting protrusion 631 is also existed out of the first guide hole 41 and abuts against an edge of the first guide hole 41, thereby restricting the first guide post 63 from being separated from the first guide hole. When assembling the position limiting structure, the stopper 40 can be installed at the shield 60 first, and then the shield 60 and the stopper 40 can be installed at the inner wall of the water tank 10 together, and the situation that the stopper 40 and the shield 60 are separated from each other during the mounting process can be avoided, thereby facilitating the assembly of the position limiting structure. Of course, in other embodiments, there may be only one first limiting protrusion 631 provided at the free end of the first guide post 63.

Referring to FIGS. 6 and 7, in order to facilitate the first limiting protrusion 631 to pass through the first guide hole 41, in one embodiment, the stopper 40 is formed with first material reduction holes 43, and the first material reduction holes 43 are arranged at intervals at an outer side of the first guide hole 41 and extending along an extension direction of the first guide hole 41. That is, each first material reduction hole 43 has a long strip shape. By providing the first material reduction holes 43 at the outer side of the first guide hole 41, the elasticity of the wall of the first guide hole 41 is increased. When the free end of the first guide post 63 is engaged in the first guide hole 41, the first limiting protrusion 631 can abut against the wall of the first guide hole 41. At this time, the wall of the first guide hole 41 can be elastically deformed toward the first material reduction holes 43, so that an abutting force between the first limiting protrusion 631 and the wall of the first guide hole 41 can be reduced, the force required for the assembly can be reduced, and the first limiting protrusion 631 can be easily passed through the first guide hole 41 to facilitate assembly of the position limiting structure. The number of the first material reduction holes 43 may be one or more. When the number of the first material reduction holes 43 is more than one, the plurality of first material reduction holes 43 are distributed at intervals along the extension direction of the first guide hole 41, so that a length of each first material reduction hole 43 can be reduced, which ensures that the wall of the first guide hole 41 has sufficient strength, and prevents the wall of the first guide hole 41 from being easily deformed or broken and the first limiting protrusion 631 from easily falling out. Of course, in other embodiments, the first material reduction holes 43 may be omitted.

In one embodiment, the first guide hole 41 is provided with a necking portion 42. A width of the first guide hole 41 at the necking portion 42 is smaller than a size of the first guide post 63. At the second position, the first guide post 63 is located on a side of the necking portion 42 away from the pressing block 50. Specifically, the necking portion 42 is spaced apart from the ends of the first guide hole 41, and a distance between the necking portion 42 and the first guide hole 41 is larger than a diameter of the first guide post 63, so that the first guide post 63 can pass over the necking portion 42 and be located on the side of the necking portion 42 away from the pressing block 50. In this way, when the stopper 40 is at the second position, the movement of the stopper 40 toward the first position can be restricted by the necking portion 42, thereby avoiding the situation that the machine body 20 cannot be normally taken out or scratched due to the interference between the stopper 40 and the machine body 20 during the process of taking out the machine body 20 from the water tank 10. In one embodiment, the stopper 40 is provided with a first material reduction hole 43 corresponding to the necking portion 42, so as to reduce the friction between the necking portion 42 and the first guide post 63 and reduce abrasion when the first guide post 63 passes through the necking portion 42. A protrusion may be provided at one side wall of the first guide hole 41 to form the necking portion 42, or protrusions may be provided at both side walls of the first guide hole 41 to form the necking portion 42, or when the first material reduction hole 43 is provided, the side wall of the first guide hole 41 may be raised inward to form the necking portion 42.

Referring to FIGS. 7 and 8, in order to reduce the friction exerted on the stopper 40 in the sliding process, in one embodiment, the stopper 40 has at least one first sliding surface, the first sliding surface facing the shield 60 or the inner wall of the water tank 10. The first sliding surface is provided with a first sliding rib 44, and the first sliding rib 44 extends along the sliding direction of the stopper 40. It should be noted that, the first sliding surface is a surface of the stopper 40 that can contact the shield 60 or the inner wall of the water tank 10. By providing the first sliding rib 44 on the first sliding surface, a contact area between the stopper 40 and the shield 60 (or the inner wall of the water tank 10) can be reduced by contacting the stopper 40 with the shield 60 (or the inner wall of the water tank 10) through the first sliding rib 44, so that the friction exerted on the stopper 40 during sliding can be reduced when the stopper slides relative to the shield 60 (or the inner wall of the water tank 10), and the sliding effect can be improved. A cross section of the first sliding rib 44 may be semicircular, square, or triangular. For example, the cross section of the first sliding rib 44 is semicircular, there is only linear contact between the first sliding rib 44 and the shield 60 (or the inner wall of the water tank 10), thereby further reducing friction and friction resistance.

The stopper 40 may have only one first sliding surface facing the shield 60 or the inner wall of the water tank 10, or may have a plurality of first sliding surfaces. For example, in the embodiment that the stopper 40 is slidably mounted in the first guide groove 61, the stopper 40 has four first sliding surfaces, one of the four first sliding surfaces faces an upper side wall of the first guide groove 61, one of the four first sliding surfaces faces a lower side wall of the first guide groove 61, one of the four first sliding surfaces faces a groove bottom wall of the first guide groove 61, and one of the four first sliding surfaces faces the inner wall of the water tank 10. Each of the first sliding surfaces is provided with a first sliding rib 44. Of course, the first sliding rib(s) 44 may be provided at parts of the first sliding surfaces.

Referring to FIGS. 8 and 10, in one embodiment, a second guide structure is provided between the shield 60 and the pressing block 50, and the second guide structure is configured to restrict the pressing block 50 from moving in the transverse direction. Specifically, the second guide structure extends along the sliding direction of the pressing block 50 to ensure that the pressing block 50 can slide smoothly between the inner wall of the water tank 10 and the shield 60. Since the second guide structure is disposed between the shield 60 and the pressing block 50, there is no need to provide a guide structure on the inner wall of the water tank 10, thereby simplifying the structure of the water tank 10. Of course, in other embodiments, the second guide structure may be provided between the water tank 10 and the pressing block 50.

The second guide structure may have one of various configurations. For example, in one embodiment, the second guide structure includes a second guide groove 64 formed at the shield 60. The second guide groove 64 extends in the up and down direction and has a second exiting opening 641 facing upward. The pressing block 50 is slidably mounted in the second guide groove 64 and can protrude out from the second existing opening 641. Specifically, the second guide groove 64 extends in the sliding direction (i.e., the up and down direction) of the pressing block 50, the second exiting opening 641 is located at an upper end of the second guide groove 64, and the lower end of the second guide groove 64 penetrates through an upper groove wall of the first guide groove 61. In one embodiment, the pressing block 50 is wholly and slidably mounted within the second guide groove 64. In this way, the structural strength of the second guide structure is high, and the movement reliability of the pressing block 50 can be ensured to be good. Of course, the pressing block 50 may be partially and slidably mounted in the second guide groove 64. Of course, this application is not limited to this, and the second guide groove 64 may be formed at the pressing block 50. The second guide structure includes a protrusion provided at the shield 60, and the protrusion can protrude from the second guide groove 64.

In addition, in an embodiment, the second guide structure includes a second guide hole 51 formed at the pressing block 50 and a second guide post 65 provided at the shield 60. The second guide hole 51 extends in the up and down direction to form a long strip shape, and the second guide post 65 is slidably mounted in the second guide hole 51. Specifically, the second guide hole 51 extends along the sliding direction of the pressing block 50 to form a long strip shape, and both ends of the second guide hole 51 are closed, so that the second guide post 65 can always be located in the second guide hole 51. That is, the pressing block 50 can be guided to slide, and the pressing block 50 can be prevented from being separated from the shield 60, so that the overall reliability of the position limiting structure is high. A number of the second guide posts 65 may be one or more. When the number of the second guide posts 65 is more than one, the plurality of second guide posts 65 are spaced apart in the sliding direction of the pressing block 50. Of course, this application is not limited to this, and the second guide hole 51 may be formed at the shield 60 and the second guide post 65 may be provided at the pressing block 50. In addition, in one embodiment, the second guide structure may include a second guide groove 64, the second guide post 65 provided in the second guide groove 64, and the second guide hole 51 formed at the stopper 40.

In one embodiment, the second guide hole 51 is arranged from one side of the pressing block 50 toward a direction close to the other opposite side. That is, the second guide hole 51 is offset from a midpoint position between the two opposite sides of the pressing block 50. The second guide post 65 is provided at a groove bottom wall of the second guide groove 64, and the second guide post 65 is provided corresponding to the second guide hole 51. That is, the second guide post 65 is also offset from a midpoint position of two groove side walls of the second guide groove 64. In this way, it can ensure that both the pressing block 50 and the shield 60 have unique installation states, and it can prevent the pressing block 50 from being installed in reverse. Of course, in other embodiments, the second guide hole 51 can be provided at the midpoint position of the two opposite sides of the pressing block 50.

In order to facilitate the assembly of the position limiting structure, in one embodiment, the second guide post 65 is provided with a second limiting protrusion 651. The second limiting protrusion 651 is located at a free end of the second guide post 65 and protrudes toward a lateral direction of the second guide post 65. The pressing block 50 is slidably installed between the second limiting protrusion 651 and the shield 60. Specifically, each of two opposite sides of the free end of the second guide post 65 is provided with one second limiting protrusion 651. Two second limiting projections 651 are distributed along a width direction of the second guide hole 51. A protrusion height of the second limiting protrusion 651 relative to a side surface of the second guide post 65 is greater than a gap between the second guide post 65 and the second guide hole 51, and a distance between the second limiting protrusion 651 and a root portion of the second guide post 65 is greater than a depth of the second guide hole 51. After the free end of the second guide post 65 enters from one end of the second guide hole 51 and existed out from the other end of the second guide hole 51, the second limiting protrusion 651 is also existed out of the second guide hole 51 and abuts against an edge of the second guide hole 51, thereby restricting the second guide post 65 from being separated from the second guide hole. When assembling the position limiting structure, the pressing block 50 can be installed at the shield 60 first, and then the shield 60 and the pressing block 50 can be installed at the inner wall of the water tank 10 together, and the situation that the pressing block 50 and the shield 60 are separated from each other during the installation process can be avoided, thereby facilitating the assembly of the position limiting structure. Of course, in other embodiments, there may be only one second limiting protrusion 651 provided at the free end of the second guide post 65.

In order to facilitate the second limiting protrusion 651 to pass through the second guide hole 51, in one embodiment, the pressing block 50 is formed with second material reduction holes 52, and the second material reduction holes 52 are arranged at intervals outside the second guide hole 51 and extending along an extension direction of the second guide hole 51. That is, each second material reduction hole 52 has a long strip shape. By providing the second material reduction holes 52 outside the second guide hole 51, the elasticity of the wall of the second guide hole 51 is increased. When the free end of the second guide post 65 is engaged in the second guide hole 51, the second limiting protrusion 651 can abut against the wall of the second guide hole 51. At this time, the wall of the second guide hole 51 can be elastically deformed toward the second material reduction holes 52, so that an abutting force between the second limiting protrusion 651 and the wall of the second guide hole 51 can be reduced, the force required for assembly can be reduced, and the second limiting protrusion 651 can be easily passed through the second guide hole 51 to facilitate assembly of the position limiting structure. The number of the second material reduction holes 52 may be one or more. When the number of the second material reduction holes 52 is more than one, the plurality of second material reduction holes 52 are distributed at intervals along the extension direction of the second guide hole 51, so that a length of each second material reduction holes 52 can be reduced, which ensures that the wall of the second guide hole 51 has sufficient strength, and prevents the wall of the second guide hole 51 from being easily deformed or broken and the second limiting protrusion 651 from easily falling out. Of course, in other embodiments, the second material reduction holes 52 may be omitted.

Figure 9:
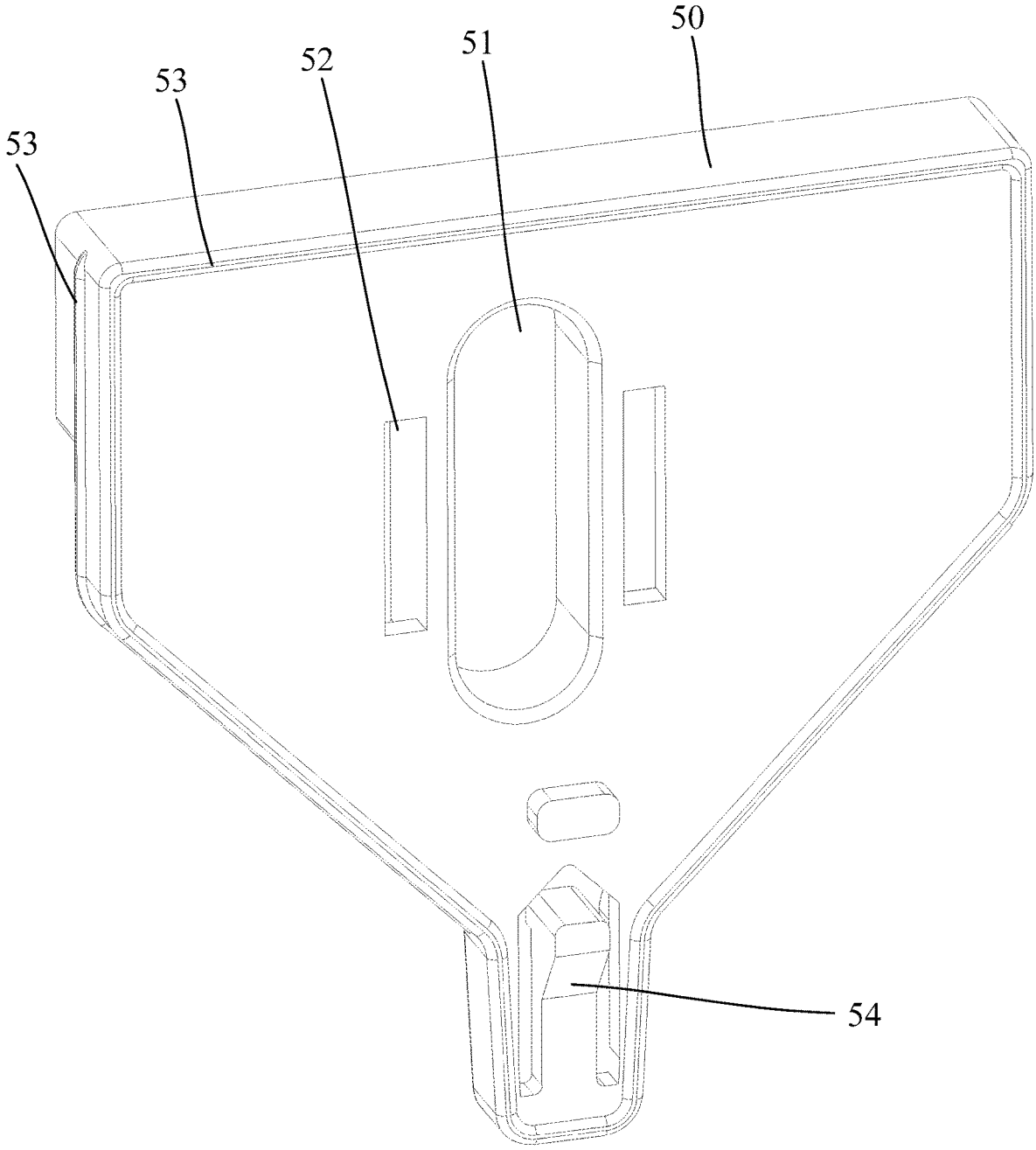
FIG. 9 is a schematic view of the pressing block of FIG. 8 from another side.

Referring to FIGS. 8 and 9, in order to reduce the friction exerted on the pressing block 50 in the sliding process, in one embodiment, the pressing block 50 has at least one second sliding surface, the second sliding surface facing the shield 60 or the inner wall of the water tank 10. The second sliding surface is provided with a second sliding rib 53, and the second sliding rib 53 extends along the sliding direction of the pressing block 50. It should be noted that, the second sliding surface is a surface of the pressing block 50 that can contact the shield 60 or the inner wall of the water tank 10. By providing the second sliding rib 53 on the second sliding surface, a contact area between the pressing block 50 and the shield 60 (or the inner wall of the water tank 10) can be reduced by contacting the pressing block 50 with the shield 60 (or the inner wall of the water tank 10) through the second sliding rib 53, so that the friction exerted on the pressing block 50 during sliding can be reduced when the pressing block 50 slides relative to the shield 60 (or the inner wall of the water tank 10), and the sliding effect can be improved. A cross-section of the second sliding rib 53 may be semicircular, square, or triangular. For example, the cross-section of the second sliding rib 53 is semicircular, there is only linear contact between the second sliding rib 53 and the shield 60 (or the inner wall of the water tank 10), thereby further reducing friction and frictional resistance.

The pressing block 50 may have only one second sliding surface facing the shield 60 or the inner wall of the water tank 10, or have a plurality of second sliding surfaces. For example, in the embodiment that the pressing block 50 is slidably mounted in the second guide groove 64, the pressing block 50 has four second sliding surfaces, one of the four second sliding surfaces faces an upper side wall of the second guide groove 64, one of the four second sliding surfaces faces a lower side wall of the second guide groove 64, one of the four second sliding surfaces faces a groove bottom wall of the second guide groove 64, and one of the four second sliding surfaces faces the inner wall of the water tank 10. Each of the second sliding surfaces is provided with a second sliding rib 53. Of course, the second sliding rib(s) 53 may be provided at parts of the second sliding surfaces.

Referring to FIGS. 5 and 6, in an embodiment, a clamping structure is provided between the pressing block 50 and the shield 60. At the first position, the pressing block 50 is clamped with the shield 60. In this way, the stopper 40 can be restricted from switching from the first position to the second position, that is, the stopper 40 can be prevented from automatically switching to the second position before the user discharges the dehumidification water in the water tank 10.

Figure 11:
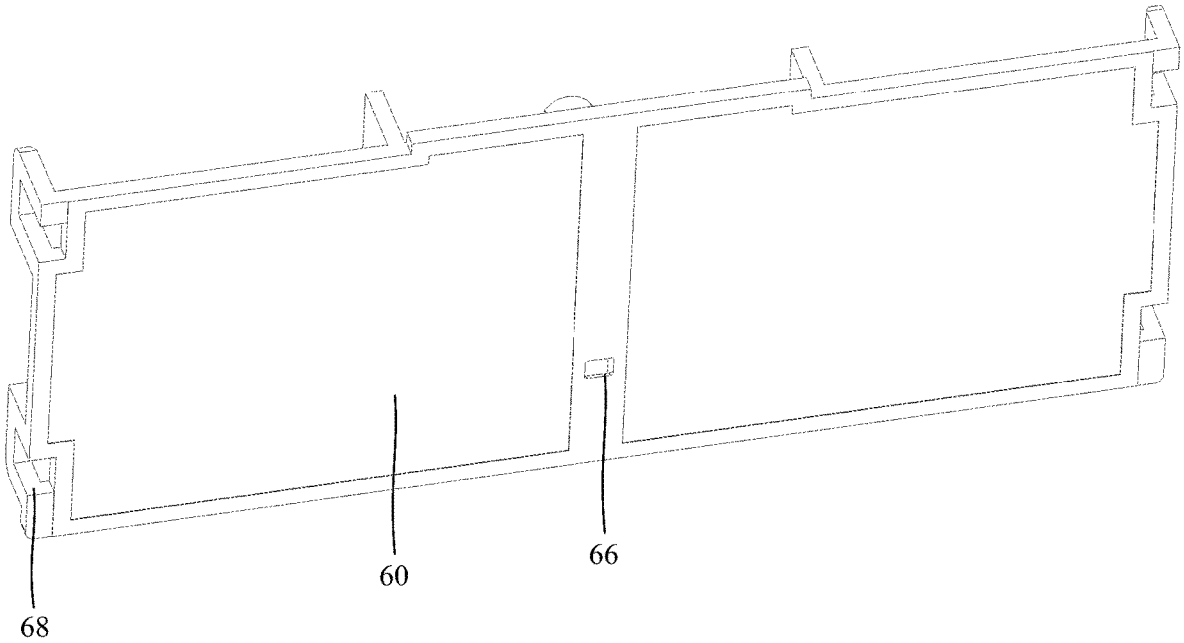
FIG. 11 is a schematic view of the shield of FIG. 10 from another side.

Referring to FIGS. 9 to 11, the clamping structure can be one of various configurations. For example, in one embodiment, the pressing block 50 is provided with an elastic buckle 54, and a surface of the shield 60 facing the mounting position is formed with a stop hole 66. The stop hole 66 extends through a surface of the shield 60 facing away from the mounting position. At the first position, the elastic buckle 54 is engaged in the stop hole 66. That is, the elastic buckle 54 and the stop hole 66 constitute the clamping structure, in other words, the clamping structure includes the elastic buckle 54 and the stop hole 66. When the pressing block 50 is pressed down to drive the stopper 40 to move to the first position, the elastic buckle 54 can engage in the stop hole 66, thereby restricting the upward movement of the pressing block 50. However, when the user needs to switch the stopper 40 to the second position, the elastic buckle 54 located in the stop hole 66 can be pressed to make the elastic buckle 54 out of the stop hole 66. At this time, the pressing block 50 is no longer restricted by the stop hole 66 and can move upward, that is, the stopper 40 can be switched from the first position to the second position. By adopting the clamping structure formed by the elastic buckle 54 and the stop hole 66, it facilitates the operation of the user, and a contact force between the elastic buckle 54 and the shield 60 during the movement prior to that the elastic buckle 54 is engaged in the stop hole 66 is reduced, so that the abrasion of the elastic buckle 54 can be reduced, and the service life of the elastic buckle 54 can be prolonged. Of course, in other embodiments, the elastic buckle 54 may be provided at the shield 60, and the stop hole 66 may be formed at the pressing block 50. Alternatively, each of the shield 60 and the pressing block 50 is provided with an elastic buckle 54, and the shield 60 and the pressing block 50 are engaged with each other by elastic buckles 54.

In order to reduce the length of time of the elastic buckle 54 being pressed, in one embodiment, the surface of the shield 60 facing the mounting position is provided with an avoidance slot 67 extending in the up and down direction, and the avoidance slot 67 is above the stop hole 66 and spaced from the stop hole 66. At the second position, the elastic buckle 54 is located in the avoidance slot 67. Specifically, when the pressing block 50 moves upward, the elastic buckle 54 comes out of the stop hole 66 and passes over a spacing between the stop hole 66 and the avoidance slot 67, and the elastic buckle 54 then can enter the avoidance slot 67. At this time, the elastic buckle 54 is spaced apart from a groove bottom of the avoidance slot 67, that is, when the elastic buckle 54 is located in the avoidance slot 67, the elastic buckle 54 is in a free state and does not contact the shield 60. In this way, permanent deformation of the elastic buckle 54 caused by being pressed for a long time can be avoided, and the service life of the elastic buckle 54 can be prolonged. After the elastic buckle 54 slides out from the avoidance slot 67, during the movement before the elastic buckle 54 engages in the stop hole 66, the elastic buckle 54 is pressed by the shield 60 and elastically deforms. By extending the avoidance slot 67 in the up and down direction to form a long strip shape, a distance between the avoidance slot 67 and the stop hole 66 can be reduced, thereby reducing a time duration of the elastic buckle 54 being pressed, and reducing the friction between the elastic buckle 54 and the shield 60 when moving from the avoidance slot 67 to the stop hole 66, and facilitating the prolonging of the service life of the elastic buckle 54. In one embodiment, a lower side wall of the avoidance slot 67 is disposed inclined downward to provide guidance for the elastic buckle 54 to slide to the avoidance slot 67.

Figure 12:
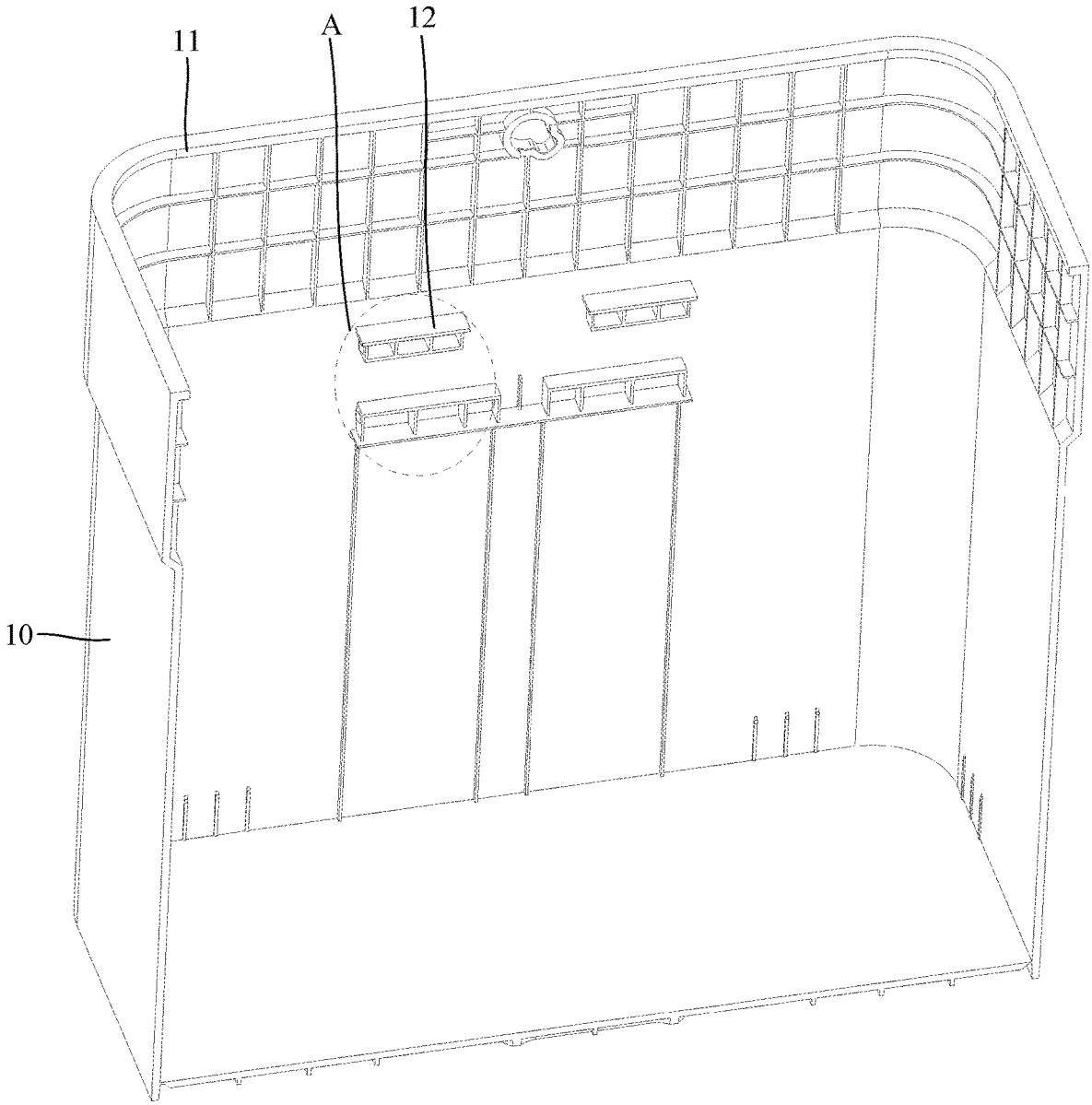
FIG. 12 is a schematic structural diagram of the water tank of FIG. 3.
Figure 13:
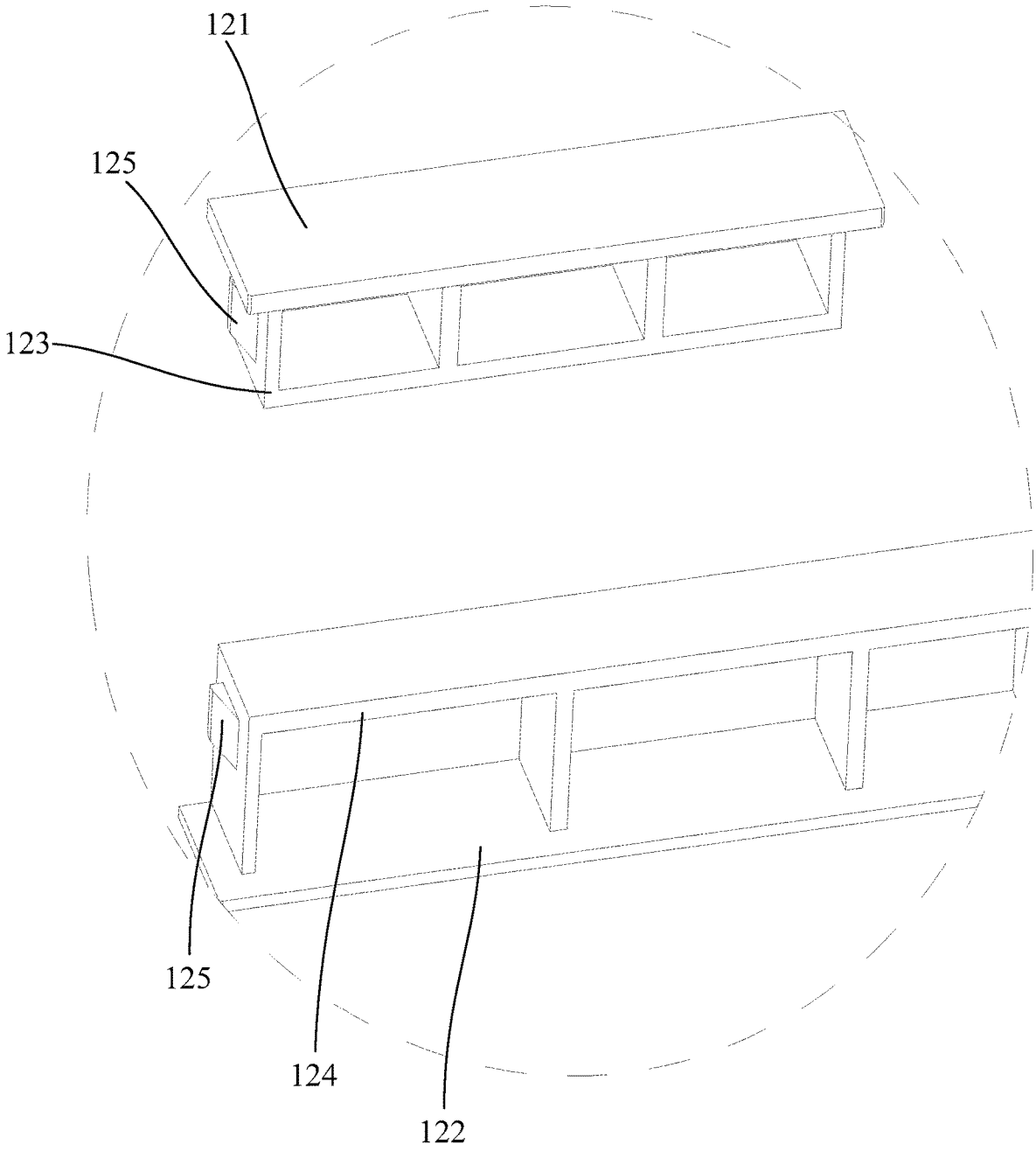
FIG. 13 is an enlarged view of portion A of FIG. 12.

Referring to FIGS. 12 and 13, in one embodiment, the support protrusion 12 includes an upper support plate 121 and a lower support plate 122 below the upper support plate 121 and spaced from the upper support plate 121, the mounting position is formed between the upper support plate 121 and the lower support plate 122. Both the upper support plate 121 and the lower support plate 122 extend transversely. The upper support plate 121 has a break, and the pressing block 50 (refer to FIG. 4) extends upward from the break. In this way, the pressing block 50 can be arranged closer to the inner wall of the water tank 10, so that an overall protrusion height of the supporting protrusion 12 and the position limiting structure relative to the inner wall of the water tank 10 can be reduced, thereby facilitating the reduction of the depth of the avoidance recess 21 on the machine body 20, and increasing an inner space of the machine body 20.

The shield 60 is provided between the upper support plate 121 and the lower support plate 122, and a lower side portion of the shield 60 can be brought into abutting against an upper plate surface of the lower support plate 122, so that the shield 60 can be supported by the lower support plate 122. An upper side portion of the shield 60 can be brought into abutting against a lower plate surface of the upper support plate 121, so that the upper support plate 121 can be supported by the lower support plate 122, and a supporting capacity of the support protrusion 12 can be improved.

In order to improve a structural strength of the upper support plate 121, in one embodiment, the support protrusion 12 further includes a first reinforcement rib 123. The first reinforcement rib 123 is connected to the lower plate surface of the upper support plate 121, and the shield 60 is provided with an avoidance position corresponding to the first reinforcement rib 123. A lower surface of the first reinforcement rib 123 may be brought into abutting against a surface facing upward at the avoidance position, so that a supporting area between the shield 60 and the supporting protrusion 12 can be increased. The first reinforcement ribs 123 may have one of various configurations, for example, the first reinforcement rib 123 may have a criss-crossing grid structure, or the first reinforcement rib 123 may be a vertical rib extending in the up and down direction.

In order to improve the structural strength of the lower support plate 122, in one embodiment, the support protrusion 12 further includes a second reinforcement rib 124, and the second reinforcement rib 124 is connected to the lower support plate 122. The second reinforcement rib 124 may be connected to an upper plate surface of the lower support plate 122. In this case, the shield 60 may also be provided with an avoidance position corresponding to the second reinforcement rib 124, and an upper surface of the second reinforcement rib 124 may be brought into abutting against a surface facing downward at the avoidance position, so that a support area between the shield 60 and the support protrusion 12 can be increased. Alternatively, the second reinforcement rib 124 may be connected to a lower plate surface of the lower support plate 122. The second reinforcement rib 124 may be one of various configurations, for example, the second reinforcement rib 124 may be a criss-crossing grid structure, or the second reinforcement rib 124 may be a vertical rib extending in the up and down direction. In one embodiment, the support protrusion 12 further includes a support rib, an upper end of the support rib is connected to the lower support plate 122, a lower end of the support rib extends toward the bottom wall of the water tank 10, and the lower end of the support rib is connected to or spaced from the bottom wall of the water tank 10.

Referring to FIGS. 10, 11 and 13, in an embodiment, the shield 60 is detachably connected to the support protrusion 12 to facilitate the assembly of the position limiting structure. In this way, when the pressing block 50, the shield 60, or the stopper 40 is damaged or worn, it can be easily replaced. Since the entire water tank 10 does not need to be replaced, the cost can be reduced. In one embodiment, the shield 60 is engaged with the support projection 12, which is convenient to assemble, and does not need to be screwed, the production efficiency is improved. Specifically, both ends of the shield 60 along the sliding direction of the stopper 40 are provided with buckle holes 68, and the first reinforcement rib 123 is provided with a buckle 125 corresponding to each buckle hole 68. The buckle 125 protruding along the sliding direction of the stopper 40. The shield 60 are engaged with the support protrusion 12 through the buckle 125 and the buckle holes 68. In one embodiment, the buckle holes 68 are provided above and below the stopper 40 to ensure the connection reliability between the shield 60 and the supporting protrusion 12. Of course, in other embodiments, the shield 60 and the support protrusion 12 may also be connected by screws or the like.

The foregoing are only preferred embodiments of this application, and do not limit the scope of this application. All equivalent structural changes made within the concept of this application, using the contents of the specification and drawings of this application, or direct/indirect application in other related technical fields are included in the scope of patent protection of this application.

What is claimed is:

1. A dehumidifier comprising:

a water tank;

a machine body configured to be at least partially accommodated in the water tank in an idle state; and a position limiting structure including a stopper movably mounted at a side wall of the water tank, the stopper being configured to move between:

a first position, at which the stopper is located on a movement path of the machine body moving toward inside of the water tank, to restrict the machine body from moving to the idle state; and a second position, at which the stopper avoids the movement path of the machine body moving toward the inside of the water tank, to allow the machine body to move to the idle state;

wherein:

the machine body is further configured to extend out relative to the water tank in a working state;

the water tank includes a support protrusion at an inner wall of the water tank;

the machine body includes an avoidance recess at a side of the machine body and extending to a bottom of the machine body;

in the idle state, the support protrusion extends into the avoidance recess; and in the working state, the bottom of the machine body is supported by an upper end of the support protrusion.

2. The dehumidifier of claim 1, wherein:

a mounting position is arranged below the support protrusion;

the stopper is slidably installed at the mounting position and a sliding direction of the stopper is along a transverse direction;

at the first position, the stopper extends laterally toward the support protrusion to be positioned on the movement path of the machine body moving toward the inside of the water tank; and at the second position, the stopper is retracted to be at the mounting position to avoid the movement path of the machine body moving toward the inside the water tank.

3. The dehumidifier of claim 2, wherein the position limiting structure further includes:

a pressing block slidably installed at the water tank and configured to slide along an up and down direction; and a linkage structure between the pressing block and the stopper, and configured to cause the stopper to slide from the second position to the first position in response to the pressing block sliding downward.

4. The dehumidifier of claim 3, wherein:

the pressing block is slidably mounted at the mounting position;

an upper end of the pressing block is higher when the stopper is at the second position than when the stopper is at the first position.

5. The dehumidifier of claim 4, wherein the linkage structure includes a first sliding member provided at the pressing block and a second sliding member provided at the stopper, and at least one of the first sliding member or the second sliding member extends obliquely upward in a sliding-out direction in which the stopper slides out of the mounting position.

6. The dehumidifier of claim 5, wherein:

the first sliding member includes a sliding groove extending obliquely upward in the sliding-out direction, and the second sliding member includes a sliding protrusion slidably mounted in the sliding groove; and/or the first sliding member has a first surface facing downward and the second sliding member has a second surface facing the first surface, and at least one of the first surface or the second surface extends obliquely upward in the sliding-out direction.

7. The dehumidifier of claim 4, wherein:

the position limiting structure further includes a shield covering the mounting position; and the stopper and the pressing block are located between the shield and the inner wall of the water tank.

8. The dehumidifier of claim 7, wherein a guide structure is provided between the shield and the stopper, and is configured to restrict a movement of the stopper in the up and down direction.

9. The dehumidifier of claim 8, wherein:

the guide structure includes a guide groove formed at the shield, extending transversally, and having an exiting opening; and the stopper is slidably mounted in the guide groove and configured to protrude from the exiting opening.

10. The dehumidifier of claim 8, wherein the guide structure includes:

a guide hole formed at the stopper and extending transversally to form a long strip shape; and a guide post provided at the shield and slidably installed in the guide hole.

11. The dehumidifier of claim 10, wherein:

the guide post includes a limiting protrusion located at a free end of the guide post and protruding toward a lateral direction of the guide post; and the stopper is slidably installed between the limiting protrusion and the shield.

12. The dehumidifier of claim 11, wherein the stopper is formed with material reduction holes arranged at an outer side of the guide hole at intervals and extending along an extension direction of the guide hole.

13. The dehumidifier of claim 12, wherein:

the guide hole is provided with a necking portion, a width of the guide hole at the necking portion being smaller than a size of the guide post; and when the stopper is at the second position, the guide post is located on a side of the necking portion away from the pressing block.

14. The dehumidifier of claim 7, wherein the stopper has a sliding surface facing the shield or the inner wall of the water tank, and the first sliding surface is provided with a sliding rib extending along the sliding direction of the stopper.

15. The dehumidifier of claim 7, wherein a guide structure is provided between the shield and the pressing block, and is configured to restrict a movement of the pressing block in the transverse direction.

16. The dehumidifier of claim 15, wherein:

the guide structure includes a guide groove formed at the shield, extending in the up and down direction, and having an existing opening facing upward, and the pressing block is slidably mounted in the guide groove and configured to protrude from the protruding opening; and/or the guide structure includes a guide hole formed at the pressing block and a guide post configured on the shield, the guide hole extends along the up and down direction to form a long strip shape, and the guide post is slidably installed in the guide hole.

17. The dehumidifier of claim 15, wherein:

the pressing block is provided with an elastic buckle;

a surface of the shield facing the mounting position is formed with a stop hole extending and penetrating through a surface of the shield facing away from the mounting position; and when the stopper is at the first position, the elastic buckle is engaged in the stop hole.

18. The dehumidifier of claim 17, wherein:

the surface of the shield facing the mounting position is formed with an avoidance slot extending in the up and down direction, the avoidance slot being arranged above the stop hole and spaced from the stop hole; and when the stopper is at the second position, the elastic buckle is located in the avoidance slot.

19. The dehumidifier of claim 7, wherein:

the support protrusion includes an upper support plate and a lower support plate arranged below the upper support plate and spaced from the upper support plate;

the mounting position is formed between the upper support plate and the lower support plate;

the upper support plate and the lower support plate extend transversely;

the upper support plate has a break; and the pressing block is configured to extend upward from the break.

20. The dehumidifier of claim 19, wherein the shield is detachably connected to the support protrusion.

* * * * *